US008378937B2

(12) United States Patent
Iba et al.

(10) Patent No.: US 8,378,937 B2
(45) Date of Patent: Feb. 19, 2013

(54) IMAGE DISPLAY APPARATUS

(75) Inventors: Jun Iba, Yokohama (JP); Toshiharu Sumiya, Atsugi (JP); Hisanobu Azuma, Hadano (JP)

(73) Assignee: Canon Kabushiki Kaisha, Tokyo (JP)

( * ) Notice: Subject to any disclaimer, the term of this patent is extended or adjusted under 35 U.S.C. 154(b) by 596 days.

(21) Appl. No.: 12/620,346

(22) Filed: Nov. 17, 2009

(65) Prior Publication Data

US 2010/0123744 A1 May 20, 2010

(30) Foreign Application Priority Data

Nov. 18, 2008 (JP) ..... 2008-294592

(51) Int. Cl.
*G09G 3/30* (2006.01)

(52) U.S. Cl. ..... 345/77; 345/76; 345/49; 345/83; 345/84; 345/105; 345/694; 345/60

(58) Field of Classification Search ..... None
See application file for complete search history.

(56) References Cited

U.S. PATENT DOCUMENTS

| | | | | |
|---|---|---|---|---|
| 5,838,095 | A | 11/1998 | Tanaka | |
| 2001/0019247 | A1 | 9/2001 | Tsukamoto | |
| 2007/0171159 | A1* | 7/2007 | Lee | 345/83 |
| 2010/0090931 | A1* | 4/2010 | Kawabe | 345/76 |

FOREIGN PATENT DOCUMENTS

| | | | |
|---|---|---|---|
| JP | 3170996 | A | 7/1991 |
| JP | 9092131 | A | 4/1997 |
| JP | 2001-167693 | A | 6/2001 |
| JP | 2001-229809 | A | 8/2001 |
| JP | 2001-282179 | A | 10/2001 |

* cited by examiner

*Primary Examiner* — Joseph Haley
*Assistant Examiner* — Ifedayo Iluyomade
(74) *Attorney, Agent, or Firm* — Canon, U.S.A., Inc. IP Division

(57) ABSTRACT

In an image display apparatus, each sub-pixel includes a phosphor configured to emit light of a predetermined color when the phosphor is irradiated with electrons, an electron emission device configured to irradiate the phosphor with the electrons, and a resistor connected in series to the electron emission device and having a negative temperature characteristic of resistance. In three or more sub-pixels with different luminescent colors included in each pixel, the resistor is configured such that a sub-pixel having a phosphor with a smaller temperature dependency of luminescent brightness has a resistor with a greater activation energy, or the resistor is configured such that the resistor is made of the same material for the three or more sub-pixel and such that a sub-pixel having a phosphor with a smaller temperature dependency of luminescent brightness has a resistor with a greater resistance.

12 Claims, 16 Drawing Sheets

IMAGE DISPLAY APPARATUS

BACKGROUND OF THE INVENTION

1. Field of the Invention

The present invention relates to an image display apparatus, and more particularly, to a configuration of an image display apparatus configured to irradiate phosphors with electrons emitted from electron emission devices thereby emitting light.

2. Description of the Related Art

In image display apparatuses using electron emission devices, it is known to connect a resistor in series to each electron emission device to stabilize the emission current of the electron emission device (Japanese Patent Laid-Open No. 9-92131, Japanese Patent Laid-Open No. 2001-282179). The resistor connected to the electron emission device may be formed of a material whose resistance exhibits negative temperature characteristics (Japanese Patent Laid-Open No. 2001-282179).

In many image display apparatuses capable of displaying a color image, there is provided an array of pixels each of which includes a plurality of sub-pixels configured to emit light of different colors, i.e., typically red, green, and blue, and the luminescent brightness of each sub-pixel is controlled to display a full-color image.

For example, if sub-pixels having red, green, and blue luminescent colors are simultaneously driven such that red, green and blue light are emitted at a particular ratio of luminescent brightness, a pixel will emit white light as a whole. However, when white light is displayed, if the luminescent brightness of a sub-pixel emitting red light is higher than a proper value, the overall color of the pixel becomes reddish white, and thus a reduction occurs in color temperature. Similarly, if the luminescent brightness of a sub-pixel that emits blue light is higher than a proper value, the resulting overall color of the pixel becomes bluish white, and thus an increase occurs in color temperature.

Japanese Patent Laid-Open No. 9-92131 discloses a field emission type display apparatus in which resistors are formed in a resistor layer between a cathode wiring and an electrode connected to one of elements of an field emission array corresponding to phosphors having luminescent colors of red, green, and blue, and the length of each resistor is determined such that predetermined white chromaticity is obtained when the respective all elements of the field emission array are driven by the same driving voltage.

Japanese Patent Laid-Open No. 3-170996 discloses a fluorescent image display apparatus in which a chromaticity correction resistor is provided for each luminescent color, and the resistance of the resistor is determined such that chromaticity is equal for all pixels when white light is emitted by the pixels including phosphor layers for emitting red, green, and blue light.

SUMMARY OF THE INVENTION

However, even if the amount of electron irradiation maintained constant, the luminescent brightness of the phosphors can vary depending on the temperature of the phosphors, i.e., the phosphors can have temperature dependency of luminescent brightness. Besides, the temperature dependency of luminescent brightness can vary depending on the type (material) of the phosphors. Therefore, if the temperature of the phosphor changes, a change occurs in chromaticity of color of the pixel even if the amount of electron irradiation is constant. In view of the above, the present invention provides an image display apparatus in which a change in chromaticity of color of pixels with a change in temperature of phosphors is minimized.

According to an aspect of the present invention, there is provided an image display apparatus including a plurality of pixels each including three or more sub-pixels having different luminescent colors, the pixels being configured such that each sub-pixel includes a phosphor configured to emit light of a predetermined color when the phosphor is irradiated with electrons, an electron emission device configured to irradiate the phosphor with the electrons, and a resistor connected in series to the electron emission device and having a negative temperature characteristic of resistance, the temperature dependency of luminescent brightness of the phosphor and the activation energy of the resistor are different among the three or more sub-pixels with different luminescent colors included in each pixel, and in the three or more sub-pixels with different luminescent colors included in each pixel, a sub-pixel having a phosphor with a smaller temperature dependency of luminescent brightness has a resistor with a greater activation energy.

According to another aspect of the present invention, there is provided an image display apparatus including a plurality of pixels each including three or more sub-pixels having different luminescent colors, the pixels being configured such that each sub-pixel includes a phosphor configured to emit light of a predetermined color when the phosphor is irradiated with electrons, an electron emission device configured to irradiate the phosphor with the electrons, and a resistor connected in series to the electron emission device and having a negative temperature characteristic of resistance, the temperature dependency of luminescent brightness of the phosphor is different among the three or more sub-pixels with different luminescent colors included in each pixel, the resistors are made of the same material for the three or more sub-pixels included in each pixel and having different luminescent colors, and in the three or more sub-pixels with different luminescent colors included in each pixel, a sub-pixel having a phosphor with a smaller temperature dependency of luminescent brightness has a resistor with a greater resistance.

The present invention provides an advantage that it is possible to reduce the change in chromaticity of colors of pixels of the image display apparatus due to a change in temperature of phosphors.

Further features of the present invention will become apparent from the following description of exemplary embodiments with reference to the attached drawings.

DESCRIPTION OF THE EMBODIMENTS

Embodiments of the present invention are described below.

Figure 1:
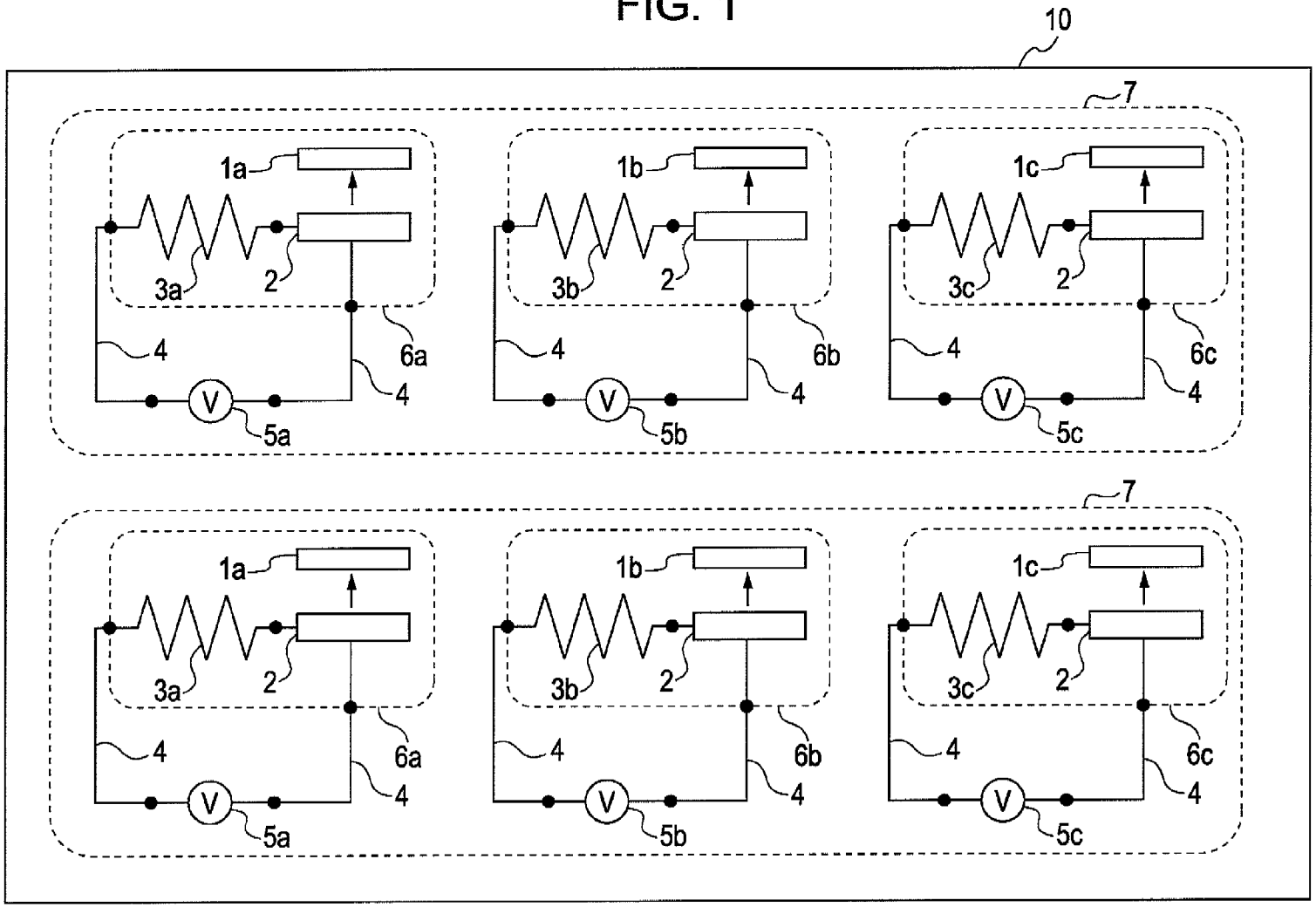
FIG. 1 is a schematic diagram illustrating an image display apparatus according to an embodiment of the present invention.

FIG. 1 is a schematic diagram illustrating a configuration of an image display apparatus according to an embodiment of the present invention. Reference numerals 1 (1*a*, 1*b*, 1*c*) denote phosphors that emit light of particular colors when they are irradiated with electrons. Reference numerals 2 denote electron emission devices that emit electrons to irradiate the phosphors 1. Reference numerals 3 (3*a*, 3*b*, 3*c*) denote resistors having resistance with negative temperature characteristics. Reference numerals 4 denote wirings via which to apply a voltage to the electron emission devices 2 and the resistors 3. Reference numerals 5 (5*a*, 5*b*, 5*c*) denote a driving unit (more specifically, a voltage applying unit) configured to supply a voltage to be applied to the electron emission devices 2 and the resistors 3 via the wirings 4.

The phosphors 1*a*, 1*b*, and 1*c* are different from each other in luminescent color and temperature dependency of luminescent brightness. The resistors 3*a*, 3*b*, and 3*c* are different from each other in activation energy and/or resistance. A combination including at least a phosphor 1, an electron emission device 2, and a resistor 3 forms one sub-pixel 6 (6*a*, 6*b*, 6*c*). Each of the sub-pixels 6*a*, 6*b*, and 6*c* is formed by a different combination of one of phosphors 1*a*, 1*b*, and 1*c* which are different from each other, one of resistors 3*a*, 3*b*, and 3*c* which are different from each other, and one electron emission device 2 (which is identical for any combination). That is, a sub-pixel 6*a* is formed by a combination of a phosphor 1*a*, an electron emission device 2, and a resistor 3*a*, a sub-pixel 6*b* is formed by a combination of a phosphor 1*b*, an electron emission device 2, and a resistor 3*b*, and a sub-pixel 6*c* is formed by a combination of a phosphor 1*c*, an electron emission device 2, and a resistor 3*c*. In each sub-pixel 6, if a change occurs in temperature, at least, of an environment in which the image display apparatus is installed, then accordingly a change occurs in the temperature of the phosphor 1 and the temperature of the resistor 3 in correlation with the change in the environmental temperature.

A combination including three or more sub-pixel, i.e., at least sub-pixels 6*a*, 6*b*, and 6*c* forms one pixel 7. Typically, each pixel 7 includes three sub-pixels providing luminescence of three primary colors, i.e., red, green, and blue. Note that in addition to the sub-pixels of red, green, and blue luminescent colors, the pixel 7 may further include one or more sub-pixels of other luminescent colors (for example, a complementary color of red, green, or blue). Conversely, in addition to the sub-pixels of red, green, and blue luminescent colors, the pixel 7 may further include one or more sub-pixels of the same luminescent color (for example, green) as one or more of red, green, and blue. Note that the additional sub-pixel having the same luminescent color do not necessary need to have different activation energy and/or resistance of the resistor, as long as the phosphors of these sub-pixels having the same luminescent color have the same temperature dependency of luminescent brightness. In the following explanation, by way of example, it is assumed that each pixel 7 includes three sub-pixels 6*a*, 6*b*, and 6*c*.

The overall chromaticity and luminescent brightness of a color provided by one pixel 7 are determined by the combination of chromaticity and luminescent brightness of luminescent colors provided by the respective sub-pixels. The sub-pixels 6*a*, 6*b*, and 6*c* of each pixel 7 are located adjacent to each other such that the overall luminescent color of the pixel 7 is observed by a user as a mixture of luminescent colors of the respective luminescent colors of sub-pixels when pixels 7 are used in the image display apparatus. Because of the close locations, the phosphors 1*a*, 1*b*, and 1*c* of the sub-pixels 6*a*, 6*b*, and 6*c* in each pixel can be regarded as being at the same environmental temperature.

The image display apparatus 10 may be configured by arranging a plurality of pixels 7. The plurality of pixels 7 may be different from each other in terms of sub-pixels 6 thereof, and more specifically, in terms of resistors 3. The image display apparatus 10 may be configured to be capable of displaying text information and/or image information such as a still image or a motion image.

Each of the components will be described in further detail below.

The temperature dependency of luminescent brightness of the phosphor refers to a property that the luminescent brightness changes with a change in temperature of the phosphor under the same electron irradiation conditions (electron beam current, energy, etc.). In the present description, when the luminescent brightness increases with increasing temperature of the phosphor, it is said that the phosphor has a positive temperature dependency of luminescent brightness. Conversely, when the luminescent brightness decreases with increasing temperature of the phosphor, it is said that the phosphor has a negative temperature dependency of luminescent brightness. Furthermore, when the increase rate of luminescent brightness of the phosphor with increasing temperature is great, it is said that the phosphor has a great temperature dependency of luminescent brightness. Conversely, when the reduction rate of luminescent brightness of the phosphor with increasing temperature is great, it is said that the phosphor has a small temperature dependency of luminescent brightness. For example, when the phosphor has a great temperature dependency of luminescent brightness, the ratio in % of the luminescent brightness at a high temperature to the luminescent brightness at a low temperature is great, while when the phosphor has a small temperature dependency of luminescent brightness, the ratio in % of the luminescent brightness at a high temperature to the luminescent brightness at a low temperature is small. In the following explanation, by way of example, it is assumed that the temperature dependency of luminescent brightness of the phosphors 1*a*, 1*b*, and 1*c* in each pixel are such that the temperature dependency of luminescent brightness of the phosphor 1*a*<the temperature dependency of luminescent brightness of the phosphor 1*b*<the temperature dependency of luminescent brightness of the phosphor 1*c*.

The luminescent brightness L per unit time of the phosphor can be represented, for example by a formula (1) shown below.

$$L=\kappa(I_e\times V_a)^\gamma \quad (1)$$

where κ denotes a luminous efficacy of the phosphor, γ denotes a gamma characteristic of the phosphor, and $I_e$ denotes an emission current indicating the amount of electrons emitted per unit time from the electron emission device 2. $V_a$ denotes an electric potential of an anode disposed close to the phosphor 1 (and more specifically, the difference between the electric potential of the anode and the electric potential of an electron emission point), which corresponds to electron energy. Simply, all electrons emitted from the electron emission device 2 can be regarded as hitting the phosphor. Because at least luminous efficacy κ depends on the temperature of the phosphor 1, the luminescent brightness L depends on the temperature under the condition of constant emission current $I_e$. Note that in the present description, it is assumed that the anode voltage $V_a$ does not depend on the temperature, and the anode voltage $V_a$ is equal for all sub-pixels 6.

There is no particular restriction on the type of the electron emission device 2, and many types such as a Spindt type, a surface conduction type, an MIM type, a MIS type, a field emission type, etc., may be used as long as electrons are emitted from a cathode when a voltage is applied between the cathode and a gate. Of these types described above as examples, the electron emission device of the field emission type (field emission device) is particularly desirable. The current-voltage characteristic of the electron emission device, i.e., the characteristic of the amount of electrons (emission current) emitted per unit time by the electron emission device 2 versus the voltage (device voltage) across the electron emission device 2 depends on the type of the electron emission device 2.

For example, in the case of the electron emission device of the Spindt type or the surface conduction type, the emission current $I_e$ is given by an F-N (Fowler-Nordheim) formula. More specifically, the current-voltage characteristic is given by a formula (2) shown below.

$$I_e=\eta\times I_f=\eta\times aV_f^2\exp(-b/V_f) \quad (2)$$

In formula (2), $I_f$ is the current (device current) flowing through the electron emission device 2 (and more particularly, through the cathode of the electron emission device 2), and η is given by $\eta=I_e/I_f$, i.e., η indicates the efficiency (electron emission efficiency) of the electron emission device 2. Furthermore, a and b are coefficients specific to the electron emission device 2, and $V_f$ is a voltage (device voltage) applied to the electron emission device 2 (and more particularly, between the cathode and the gate of the electron emission device 2).

Next, the resistor 3 is described. One resistor 3 is connected in series to each electron emission device 2. More specifically, one resistor 3 may be connected in series to the cathode of each electron emission device 2. A voltage V (driving voltage) supplied from the driving unit 5 is applied to the electron emission device 2 and the resistor 3 via the wiring 4 as described below. When the driving voltage V is applied, a voltage drop occurs across the resistor 3 having a resistance R, and a device voltage $V_f$ corresponding to the voltage drop appears across the electron emission device 2. That is, the device voltage $V_f$ is given by formula (3) shown below.

$$V_f=V-RI_f \quad (3)$$

From formula (2) and formula (3), formula (4) shown below is obtained, which indicates a relationship among the driving voltage V, the resistance R of the resistor 3 and the emission current I, of the electron emission device 2.

$$I_e=\eta\times a(V-RI_f)^2\exp\{-b/(V-RI_f)\} \quad (4)$$

Ie, $I_f$, V, and R satisfying formula (4) can be determined by plotting formula (2) and formula (3') shown below which is obtained by rewriting formula (3).

$$I_f=(V-V_f)/R \quad (3')$$

In image display apparatuses using electron emission devices, there is a possibility that an unevenness occurs in terms of electron emission characteristics among sub-pixels. To overcome the above problem, a resistor 3 is connected in series to each electron emission device 2. That is, when there is unevenness of the current-voltage characteristic of the electron emission device 2, the device current $I_f$ is controlled by the resistor 3 such that the unevenness of the characteristic is reduced. In practice, the resistance of the resistor 2 may be in a range from 100 Ω to 10 GΩ. In the image display apparatus having a typical configuration, if the resistor 3 is formed to have a resistance in the above range, the resultant resistor 3 has a negative temperature characteristic of resistance.

The negative temperature characteristic of resistance of the resistor 3 refers to such a characteristic that the resistance of the resistor decreases with increasing temperature of the resistor. The negative temperature characteristic of resistance can be typically approximated by an exponential function (5) shown below.

$$R=R_1\exp\{(E_a/k_b)\times(1/T'-1/T_1')\} \quad (5)$$

where R denotes the resistance (Ω) of the resistor at a temperature of T'(K), $R_1$ denotes the resistance (Ω) of the resistor at a temperature of $T_1$'(K), $E_a$ denotes the activation energy (eV) of the material, and $k_b$ denotes the Boltzmann constant ($8.617\times10^{-5}$ (eV/K)). Note that $E_a/k_b$ is generally called a B constant.

The activation energy $E_a$ indicates the magnitude of the change in the temperature characteristic of resistance. More specifically, the greater the activation energy, the greater the reduction in the resistance with increasing temperature. The activation energy $E_a$ varies depending on the material of the resistor 3. In practice, the activation energy $E_a$ may be in a range from 0.05 eV to 1 eV.

The resistance $R_1$ can be represented by a formula (6), shown below, as a function of a volume resistivity $\rho_1$ (Ωm), a length l in a direction in which the current flows, a thickness t of a cross section perpendicular to the direction in which the current flows, and a width w of the cross section perpendicular to the direction in which the current flows, of the material of the resistor as measured at the temperature $T_1$'.

$$R_1=\rho_1 tw/l \quad (6)$$

The greater the resistance $R_1$, the greater the reduction in resistance with increasing temperature.

The essence of the present invention is in that by increasing the emission current with increasing temperature of the phosphor such that the emission current is increased more greatly for sub-pixels having phosphors with smaller temperature dependency of luminescent brightness, thereby suppressing the change in chromaticity of colors of pixels due to differences in temperature dependency of luminescent brightness of phosphors. In a first embodiment, the activation energy of the material of the resistor of each phosphor is selected such that when the temperature dependency of luminescent brightness of the phosphors 1*a*, 1*b*, and 1*c* are such that the temperature dependency of luminescent brightness of the phosphor 1*a*<the temperature dependency of luminescent brightness of the phosphor 1*b*<the temperature dependency of luminescent brightness of the phosphor 1*c*, the activation energy of materials of the resistors are set such that the activation energy of the resistor 3*a*>the activation energy of the resistor 3*b*>the activation energy of the resistor 3*c*. That is, sub-pixels having phosphors with smaller temperature dependency of luminescent brightness have resistors with greater activation energy. In a second embodiment, when the temperature dependency of luminescent brightness of the phosphors 1*a*, 1*b*, and 1*c* in each pixel are such that the temperature dependency of luminescent brightness of the phosphor 1*a*<the temperature dependency of luminescent brightness of the phosphor 1*b*<the temperature dependency of luminescent brightness of the phosphor 1*c*, the resistors are formed of the same material such that the resistance of the resistor 3*a*>the resistance of the resistor 3*b*>the resistance of the resistor 3*c*. That is, sub-pixels having phosphors with smaller temperature dependency of luminescent brightness have resistors with greater resistances. The details of the first and second embodiments will be described later.

Figure 2A:
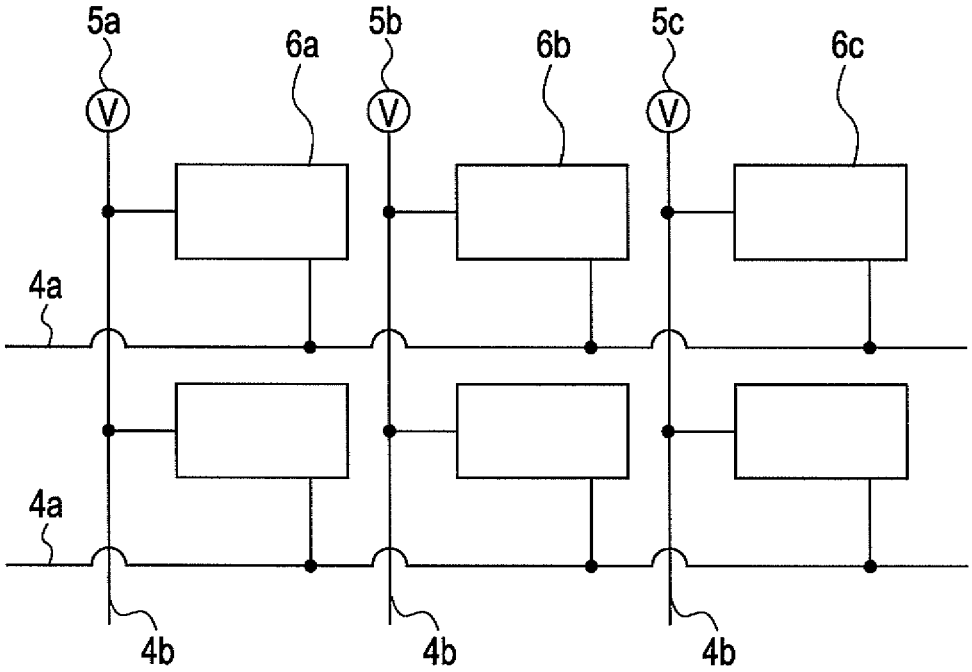
FIG. 2A is a schematic diagram illustrating a passive matrix wiring scheme.
Figure 2B:
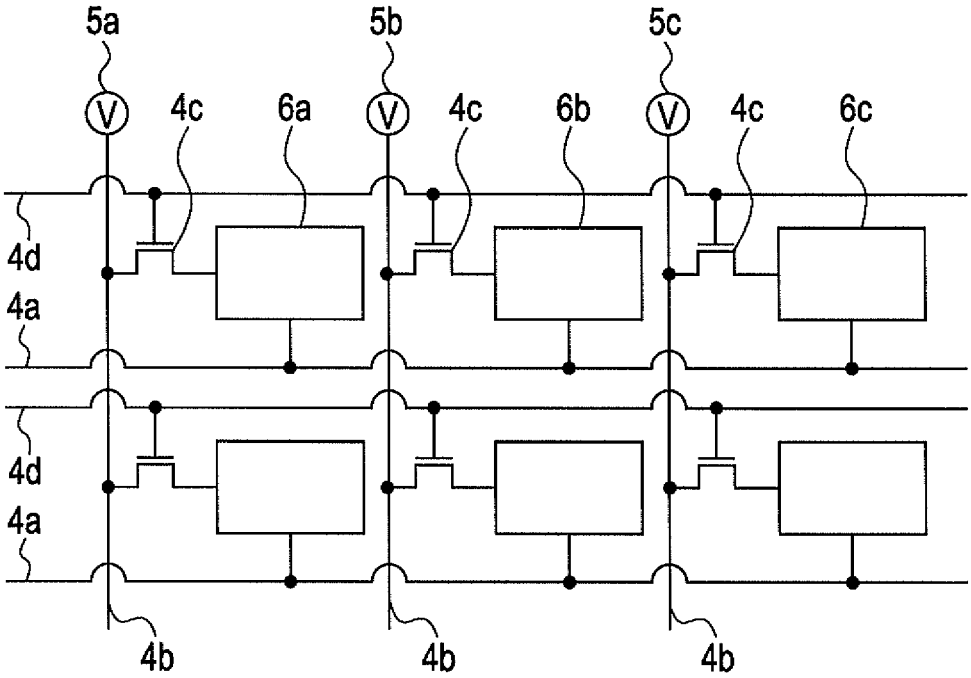
FIG. 2B is a schematic diagram illustrating an active matrix wiring scheme.

The wiring 4 and the driving unit 5 are explained below. As shown in FIG. 1, a driving unit 5 and a wiring 4 may be provided independently for each of the sub-pixels 6 such that a voltage is supplied to each sub-pixel 6 by a corresponding individual driving unit 5 and a wiring 4. In a case where the sub-pixels 6 are arranged in the form of a two-dimensional array, the wirings 4 may be disposed in the form of a matrix as shown in FIG. 2A or FIG. 2B. In this case, as shown in FIG. 2A, a plurality of first wirings 4*a* extending in a row direction may be provided such that each first wiring 4*a* is shared by sub-pixels disposed in a corresponding row, and a plurality of second wirings 4*b* extending in a column direction may be provided such that each second wiring 4b is shared by sub-pixels disposed in a corresponding column whereby sub-pixels are driven. This wiring method is known as a passive matrix addressing technique.

Alternatively, as shown in FIG. 2B, one transistor 4*c* such as a TFT (thin film transistor) may be provided for each sub-pixel, and transistors 4c may be turned on/off via third wirings 4*d* serving as gate wirings thereby driving the sub-pixels 6. This method is known as an active matrix addressing technique. In the connection between the transistor 4*c* and the corresponding sub-pixel 6, the transistor 4*c* may be connected to the side of the electron emission device 2 or the resistor 3 of the sub-pixel 6.

At least one of the wirings 4*a*, 4*b*, and 4*d* may be configured in the form of a common electrode such that a plurality of wirings are set to be equal in electric potential. Note that part of each wiring 4 and part of each sub-pixel 6 may share a common member.

As for the driving units (voltage applying units) 5 connected to corresponding wirings 4, ones that can be regarded as constant voltage sources are used. The present invention provides its advantages when the driving voltage is substantially constant regardless of a change in temperature of components of each sub-pixel. Conversely, if constant current sources are used as the driving units 5, the device current and the emission current are always constant regardless of a change in temperature of components of each sub-pixel, and thus the advantage of the present invention are not achieved. Besides, the constant current source is generally more complicated in structure than the constant voltage source, which causes an increase in cost.

Note that the constant voltage source has a property that it operates so as to maintain its voltage, i.e., the voltage output by the constant voltage source is constant regardless of a change in a load (driving voltage/device current). Note that the definition of "constant" does not exclude a case where the value (peak value) of the voltage output by the constant voltage source and/or the period (pulse width) during which the voltage is applied are intentionally modulated according to an image to be displayed. On the contrary, it is desirable that the voltage applying unit 5 includes a modulation circuit to modulate the driving voltage in accordance with an image to be displayed. Furthermore, the voltage applying unit 5 may further include a scanning circuit to select a sub-pixel 6 to drive.

Now, the first and second embodiments of the present invention are described in further detail below.

First Embodiment

In the following explanation of the first embodiment, by way of example, it is assumed that each pixel includes three sub-pixels. In the first embodiment, when the temperature dependency of luminescent brightness of the phosphors 1*a*, 1*b*, and 1*c* in each pixel are such that the dependency of luminescent brightness of the phosphor 1*a*<the dependency of the phosphor 1*b*<the dependency of the phosphor 1*c*, the activation energy of the material of the resistor of each phosphor is selected such that the activation energy of the material of the resistor 3*a*>the activation energy of the resistor 3*b*>the activation energy of the resistor 3*c*. That is, sub-pixels having phosphors with smaller temperature dependency of luminescent brightness have resistors with greater activation energy.

Figure 3:
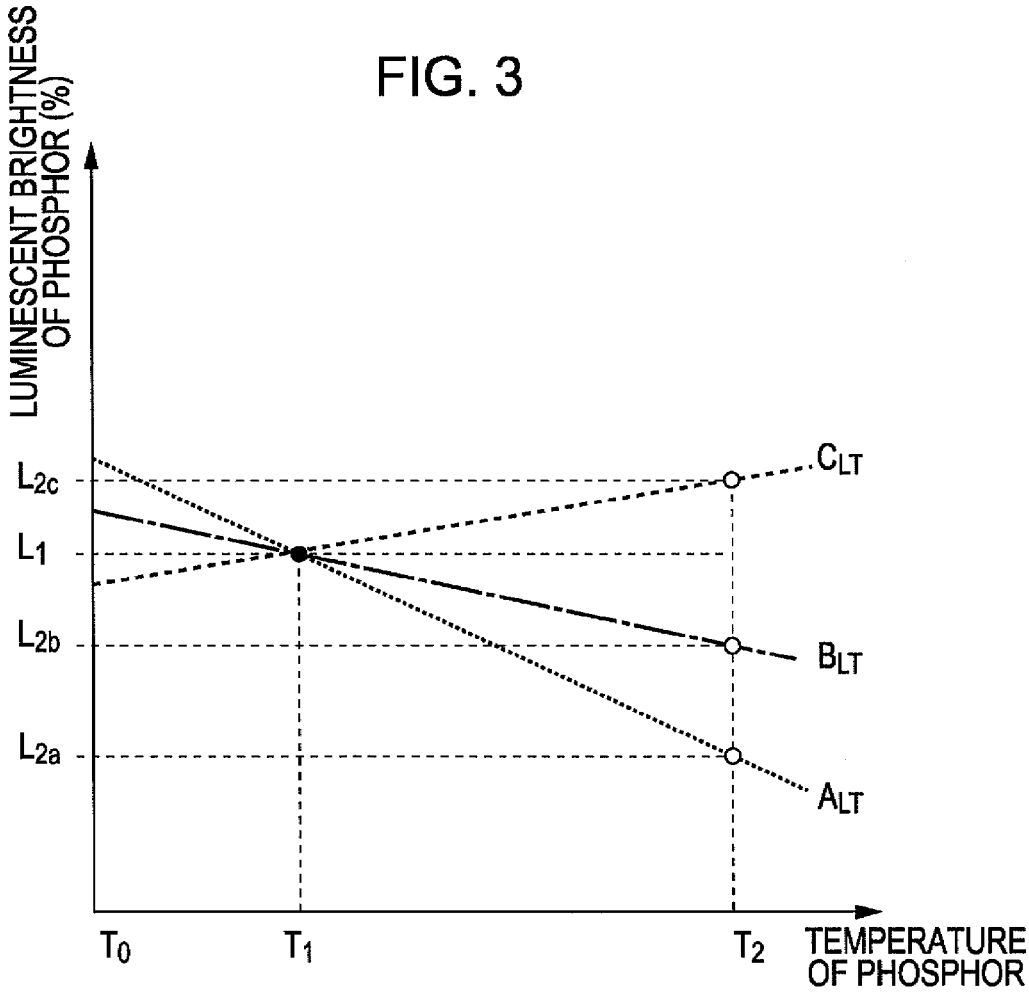
FIG. 3 is a graph representing temperature dependency of luminescent brightness of phosphors.

FIG. 3 is a graph representing examples of temperature dependency of luminescent brightness of phosphors. In FIG. 3, the luminescent brightness of the phosphors 1*a*, 1*b*, and 1*c* at a phosphor temperature $T_1$ are taken as a reference value $L_1$, and relative values $L_{2a}$, $L_{2b}$, and $L_{2c}$ of the luminescent brightness of the phosphors at temperature $T_2$ higher than $T_1$ are plotted. Herein it is assumed that no change occurs in emission current when the temperature changes from $T_1$ to $T_2$. The temperature dependency of luminescent brightness is represented by lines $A_{LT}$ (dotted line), line $B_{LT}$ (dash-dot line), and line $C_{LT}$ (dashed line) for the phosphors 1*a*, 1*b*, and 1*c*, respectively. As can be seen, the temperature dependency of luminescent brightness of the phosphor 1*a*<the temperature dependency of luminescent brightness of the phosphor 1*b*<the temperature dependency of luminescent brightness of the phosphor 1*c*. In the present example, the phosphors 1*a* and 1*b* have negative temperature dependencies of luminescent brightness, while the phosphor 1*c* has a positive temperature dependency. Note that the present embodiment is not limited to the example described above in terms of the temperature dependency of luminescent brightness. That is, the phosphor 1*c* may have a negative temperature dependency of luminescent brightness, and the phosphors 1*a* and 1*b* may have positive temperature dependencies. Although the temperature dependencies of luminescent brightness are represented by straight lines in the example shown in FIG. 3, the temperature dependency is not limited to linear dependencies. For example, the luminescent brightness (luminous efficacy) can be saturated for temperatures higher than a particular value.

In the following explanation, by way of example, it is assumed that the phosphor 1*a* emits red light, the phosphor 1*b* emits green light, and the phosphor 1*c* emits blue light. If the sub-pixels 6*a*, 6*b*, and 6*c* are driven such that the emission currents of the electron emission devices 2 are constant regardless of the temperature, the intensity of blue light increases while the intensities of green light and red light decrease with increasing temperature. As a result, the color of light emitted by the pixel 7 becomes bluish. That is, an increase in color temperature occurs.

In the present invention, the above problem is overcome as follows. The temperature dependency of luminescent brightness of the phosphor 1*c* is taken as a reference, and the ratio of the luminescent brightness of the phosphors 1*a* and 1*b* is determined from a chromaticity table such that the chromaticity of color of the pixel is maintained constant regardless of a change in temperature. When an increase occurs in temperature, the luminescent brightness of the phosphor 1*c* increases by a greater factor than factors by which the luminescent brightness of the phosphors 1*a* and 1*b* increase. To make compensation, the luminescent brightness of the phosphors 1*a* and 1*b* are controlled so as to have an additional increase such that the change in chromaticity is minimized.

In the following explanation, for simplicity, the emission currents of the respective sub-pixels at temperature $T_2$ of the sub-pixels are represented by relative values with respect to those at temperature T.

Now, the reference value and the relative value are explained. When a ratio of actual three values x, y, and z under a condition $P_1$ is $X_1:Y_1:Z_1$, and a ratio of actual three values x, y, and z under a condition $P_2$ is $X_2:Y_2:Z_2$, if the values of x, y, and z under the condition $P_1$ are taken as a reference value S, then the relative values under the condition $P_2$ are defined as $SX_2/X_1$, $SY_2/Y_1$, and $SZ_2/Z_1$. More specifically, the conditions $P_1$ and $P_2$ are in terms of phosphor temperature, and values x, y, and z are of emission currents, device voltages, or device currents.

Figure 4A:
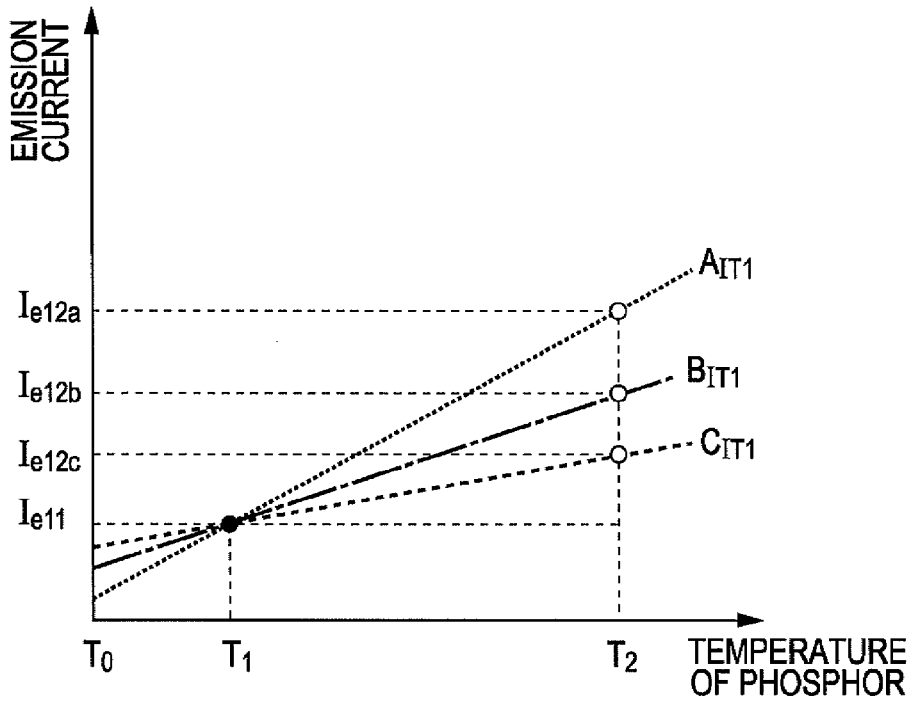
FIG. 4A is a graph representing a relationship between an emission current and temperature of a phosphor.

FIG. 4A illustrates relative values of the emission currents of the sub-pixels 6*a*, 6*b*, and 6*c* (vertical axis) when the temperature of the phosphors 1*a*, 1*b*, and 1*c* changes from $T_1$ to $T_2$ (horizontal axis). In FIG. 4A, values of the emission current of the sub-pixels 6*a*, 6*b*, and 6*c* at temperature $T_1$ are taken as a reference value $I_{e11}$. The relative values of the emission currents of the sub-pixels 6*a*, 6*b*, and 6*c* at the temperature $T_2$ are respectively $I_{e12a}$, $I_{e12b}$, and $I_{e12c}$.

The ratio of the relative values $I_{e12a}$, $I_{e12b}$, and $I_{e12c}$ of the emission currents of the respective pixels at temperature $T_2$ is set such that the ratio of the luminescent brightness of the sub-pixels at temperature $T_2$ is equal to the ratio of luminescent brightness of the sub-pixels at temperature $T_1$ at which the emission currents of the sub-pixels are taken as the reference value $I_{e11}$. Each sub-pixel has its own resistor 3 having a negative temperature characteristic of resistance. The resistance of such a resistor 3 decreases with increasing temperature. Taking into account the above fact, the emission currents are set such that $I_{e11}<I_{e12a}$, $I_{e11}<I_{e12b}$, and $I_{e11}<I_{e12c}$.

A line $A_{IT1}$ (dotted line), a line $B_{IT1}$ (dash-dot line), and a line $C_{IT1}$ (broken line) correspond to the sub-pixels 6*a*, 6*b*, and 6*c*, respectively. In FIG. 4A, a solid circle on the lines $A_{IT1}$, $B_{IT1}$, and $C_{IT1}$ denotes the reference value of the emission currents of the respective sub-pixels at temperature $T_1$, and open circles denote relative values of the emission currents of the respective emission currents at the temperature $T_2$.

Figure 4B:
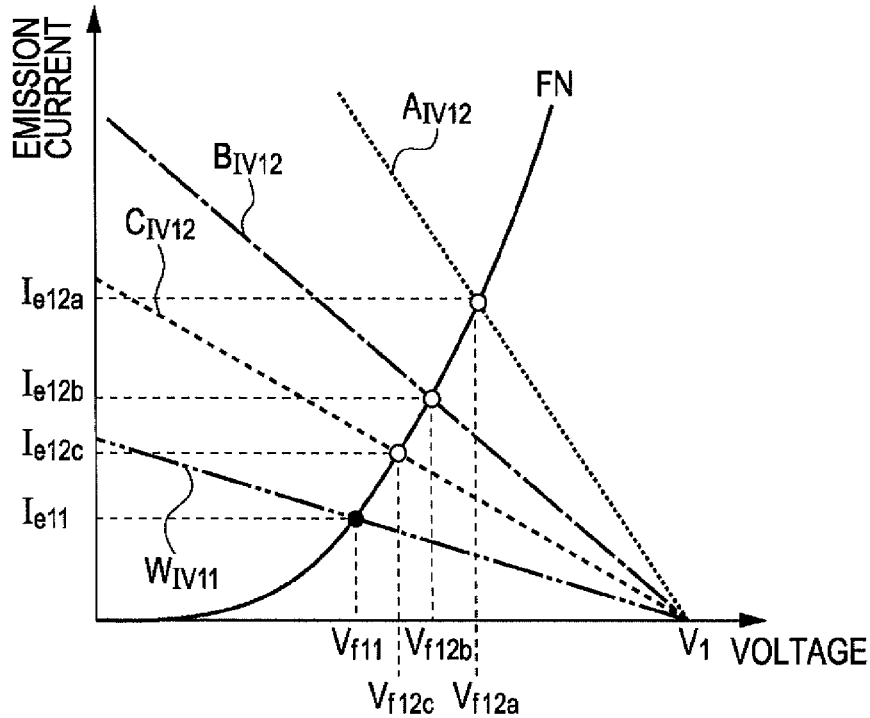
FIG. 4B is a graph representing a relationship between an emission current and a voltage applied to an electron emission device according to an embodiment of the present invention.

FIG. 4B is a graph showing device voltages and driving voltages (horizontal axis) necessary for obtaining the emission currents (vertical axis) shown in FIG. 4A. More specifically, in FIG. 4B, a line FN (solid line) represents formula (2) described above, and other lines, i.e., $W_{IV11}$ (dash-double-dot line), $A_{IV12}$ (dotted line), $B_{IV12}$ (dash-dot line), and $C_{IV12}$ (broken line) represent formula (3') described above.

If the driving voltage and the resistance of the resistor are given, the device voltage $V_f$ and the emission current $I_e$ are uniquely determined. If it is assumed that the driving voltage does not depend on the temperature, the emission current $I_e$ is determined by the resistance R of the resistor. The resistance appears in formula (3') as 1/R which is a reciprocal of a coefficient (and more strictly, the absolute value of the coefficient) of a variable $V_f$. In other words, the resistance equals to the reciprocal of the gradient (and more strictly, the absolute value of the gradient) of each of the lines $W_{IV11}$, $A_{IV12}$, and $C_{IV12}$.

From the line $W_{IV11}$, it is possible to determine the driving voltage $V_1$, the reference value $V_{f11}$ of the device voltage, and the reference value $R_{11}$ of the resistance of the resistor 3 that allows the emission current of the sub-pixel 6 to have the reference value $I_{e11}$ at the temperature $T_1$. The reference value $R_{11}$ of the resistance of the resistor 3 corresponds to the gradient of the line $W_{IV11}$.

From the line $A_{IV12}$, it is possible to determine the relative value $V_{f12a}$ of the device voltage and the relative value $R_{12a}$ of the resistance of the resistor 3*a*, that allow the emission current of the sub-pixel 6*a* to have the relative value $I_{e12a}$ at the temperature $T_2$ with respect to the reference value $I_{e11}$. The relative value $R_{12a}$ of the resistance of the resistor 3*a* corresponds to the gradient of the line $A_{IV12}$. Note that the driving voltage $V_1$ is constant regardless of whether the temperature is at $T_1$ or $T_2$.

Similarly, from the line $B_{IV12}$, it is possible to determine the relative value $V_{f12b}$, of the device voltage and the relative value $R_{12b}$ of the resistance of the resistor 3*b* that allow the emission current of the sub-pixel 6*b* to have the relative value $I_{e12b}$ at the temperature $T_2$ with respect to the reference value $I_{e11}$. The relative value $R_{12b}$ of the resistance of the resistor 3*b* corresponds to the gradient of the line $B_{IV12}$. Note that the driving voltage $V_1$ is constant regardless of whether the temperature is at $T_1$ or $T_2$.

From the line $C_{IV12}$, it is possible to determine the relative value $V_{f12c}$ of the device voltage and the relative value $R_{12c}$ of the resistance of the resistor 3*c* that allow the emission current of the sub-pixel 6*c* to have the relative value $I_{e12c}$ at the temperature $T_2$ with respect to the reference value $I_{e11}$. The relative value $R_{12c}$ of the resistance of the resistor 3*c* corresponds to the gradient of the line $C_{IV12}$. Note that the driving voltage $V_1$ is constant regardless of whether the temperature is at $T_1$ or $T_2$.

In FIG. 4B, a solid circle on the line FN indicates the relationship between the device voltage and the emission current at the temperature $T_1$, and open circles indicate the relationship between the device voltage and the emission current at the temperature $T_2$.

The essence of the present embodiment of the invention is in that by increasing the emission current in response to increasing in temperature of the phosphor from $T_1$ to $T_2$ such that the relative emission current is increased more greatly for sub-pixels having phosphors with smaller temperature dependency of luminescent brightness, thereby suppressing the change in chromaticity due to differences in temperature dependency of luminescent brightness of phosphors.

Figure 5:
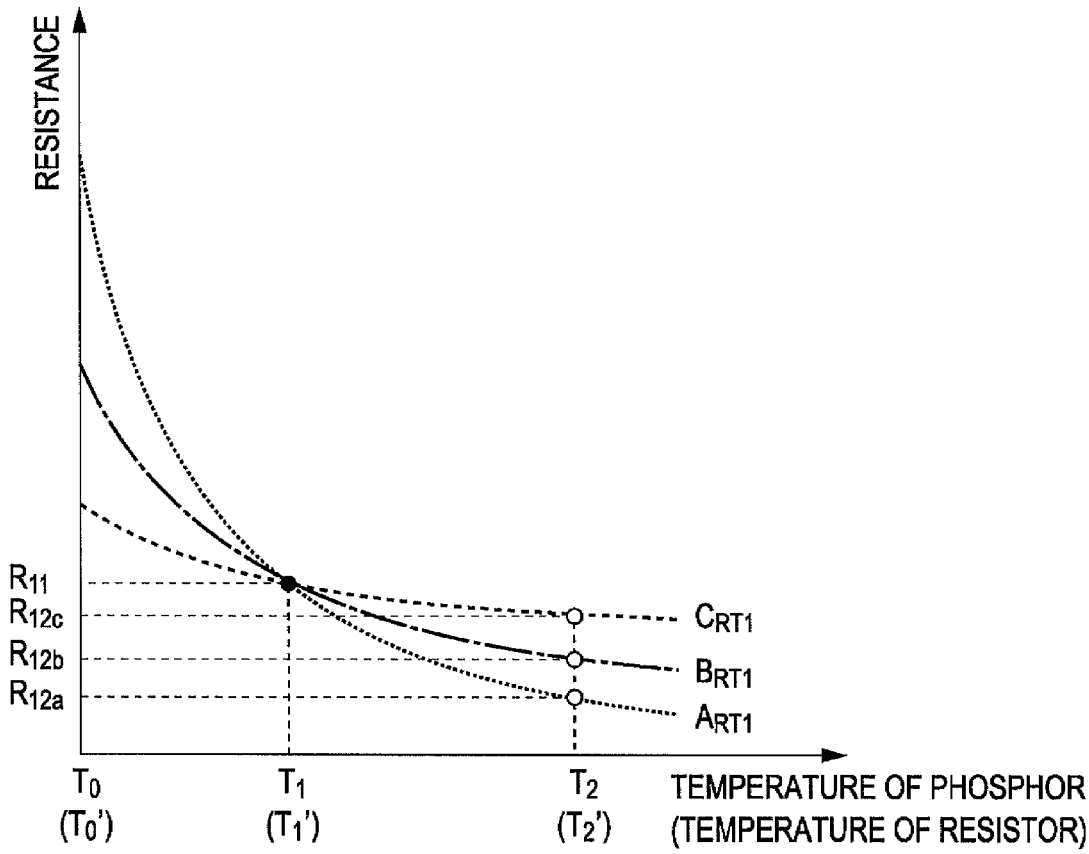
FIG. 5 is a graph representing temperature characteristics of resistance of resistors according to an embodiment of the present invention.

To increase the emission current at the phosphor temperature $T_2$ such that the emission current is increased more greatly for sub-pixels having phosphors with smaller temperature dependency of luminescent brightness, the gradients (more strictly, the absolute values of gradients) of $A_{IV12}$, $B_{IV12}$ and $C_{IV12}$) in FIG. 4B may be increased in this order. In FIG. 5, lines $A_{RT1}$ (dotted line), $B_{RT1}$ (dash-dot line), and $C_{RT1}$ (broken line) indicate temperature characteristics of resistance with respect to the reference value $R_{L1}$ of the resistance of the resistors 3*a*, 3*b*, and 3*c* at the phosphor temperature $T_1$. In FIG. 5, a solid circle on the lines $A_{RT1}$, $B_{RT1}$, and $C_{RT1}$ indicates the resistance of the resistors at the temperature $T_1$, and open circles indicate the resistance of the respective resistors at the temperature $T_2$. $T_1'$ denotes the temperature of the resistor 3 when the phosphor 1 is at a temperature $T_1$, and $T_2'$ denotes the temperature of the resistor 3 when the phosphor 1 is at a temperature $T_2$. It is desirable that the temperature of the phosphors is equal to the temperature of the resistors (i.e., $T_1=T_1'$ and $T_2=T_2'$). However, even if the temperature is different between the phosphors and the resistors, the change in phosphor temperature is mainly caused, as described above, the change in environmental temperature when the driving voltage is constant, and thus the temperature of the resistance also changes according to the environmental temperature. In the case where the temperature is different between the phosphors and the resistors, relationships among the phosphor temperature, the resistor temperature, and the environmental temperature are taken into account.

The activation energy $E_a$ of the materials of the resistors 3*a*, 3*b*, and 3*c* is as follows: the activation energy of the resistor 3*a*>the activation energy of the resistor 3*b*>the activation energy of the resistor 3*c*.

Therefore, according to formula (5), the relative values $R_{12a}$, $R_{13b}$, and $R_{12c}$ of the respective resistors 3*a*, 3*b*, and 3*c* at the resistor temperature $T_2'$ with respect to the reference value $R_{L1}$ of the resistance of the resistor 3 at the temperature $T_1'$ are in the following relationship in terms of magnitude: $R_{11}>R_{12c}>R_{12b}>R_{12a}$. Therefore, in FIG. 4B, the gradients of the lines are WIV11: $I/R_{11}$, $A_{IV12}$: $1/R_{12a}$, $B_{IV12}$: $1/R_{12b}$, and $C_{IV12}$: $1/R_{12c}$, and thus the gradient of $W_{IV11}$<the gradient of $C_{IV12}$<the gradient of $B_{IV12}$<the gradient of $A_{IV12}$.

Thus, when the phosphor temperature increases from $T_1$ to $T_2$, the emission current increases by a greater factor for a sub-pixel having a phosphor with a smaller temperature dependency of luminescent brightness, thereby making it possible to reduce the change in chromaticity of color of each pixel.

Second Embodiment

A second embodiment of the present invention is explained below assuming by way of example that each pixel includes three sub-pixels. In the second embodiment, when the temperature dependency of luminescent brightness of the phosphors 1*a*, 1*b*, and 1*c* in each pixel are such that the temperature dependency of luminescent brightness of the phosphor 1*a*<the temperature dependency of luminescent brightness of the phosphor 1*b*<the temperature dependency of luminescent brightness of the phosphor 1*a*, the resistors are made of the same material and the resistances thereof are set such that the resistance of the resistor 3*a*>the resistance of the resistor 3*b*>the resistance of the resistor 3*c*. That is, a sub-pixel having a phosphor with a smaller temperature dependency of luminescent brightness has a resistor with a greater resistance. In the first embodiment described above, the activation energy is set to be different among resistors in each pixel. In contrast, in the second embodiment, the resistors of the sub-pixels 6 in each pixel are made of the same material, and thus the activation energy is equal for all resistors. Note that this allows simplification of the production process.

The temperature dependencies of luminescent brightness of the phosphors 1*a*, 1*b*, and 1*c* are similar to those in the first embodiment and are shown in FIG. 3. For simplicity, as in the first embodiment, the emission currents of the sub-pixels at the temperature $T_2$ are represented by relative values with respect to the emission currents at the temperature $T_1$.

Figure 6A:
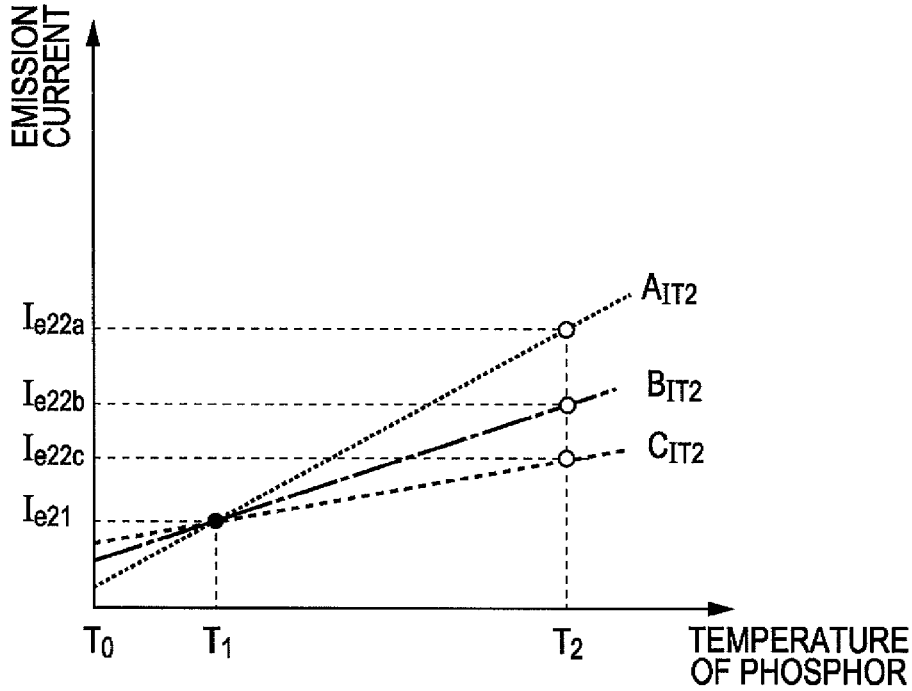
FIG. 6A is a graph representing a relationship between an emission current and temperature of a phosphor.

FIG. 6A shows, as with FIG. 4A in the first embodiment, relative relationships of the emission currents (vertical axis) of the sub-pixels 6*a*, 6*b*, and 6*c* when the temperature (horizontal axis) of the phosphors 1*a*, 1*b*, and 1*c* changes from $T_1$ to $T_2$. In FIG. 6A, the emission currents of the sub-pixels 6*a*, 6*b*, and 6*c* at the temperature $T_1$ are taken as the reference value $I_{e21}$.

The relative values of the emission currents of the sub-pixels 6*a*, 6*b*, and 6*c* at the temperature $T_2$ are $I_{e22a}$, $I_{e22}$b, and $I_{e22}$c, respectively. Herein, $I_{e22}$a, $I_{e22}$b, and $I_{e22}$c are set such that the ratio of the luminescent brightness becomes the same as that obtained when the emission currents of the respective sub-pixels at $T_1$ are set to predetermined values (reference values $I_{e21}$ in the present embodiment). A line $A_{IT2}$ (dotted line), a line $B_{IT2}$ (dash-dot line), and a line $C_{IT2}$ (broken line) correspond to the sub-pixels 6*a*, 6*b*, and 6*c*, respectively. A solid circle on the lines $A_{IT2}$, $B_{IT2}$, and $C_{IT2}$ denotes the reference value of the emission currents of the respective sub-pixels at temperature $T_1$, and open circles denote relative values of the emission currents of the respective emission currents at the temperature $T_2$.

Figure 6B:
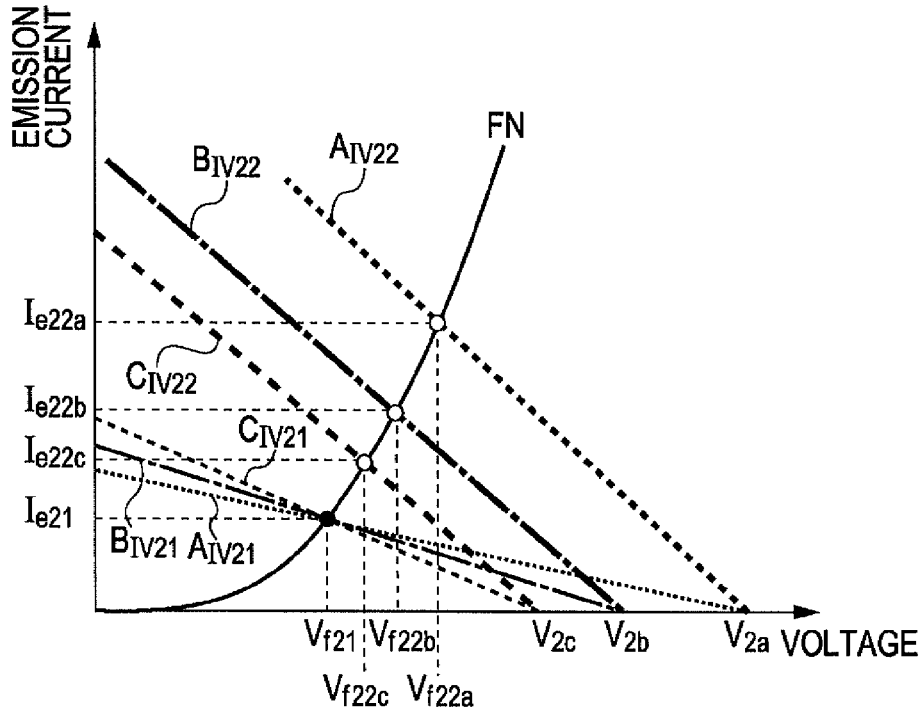
FIG. 6B is a graph representing a relationship between an emission current and a voltage applied to an electron emission device according to an embodiment of the present invention.

FIG. 6B is a graph showing device voltages and driving voltages (horizontal axis) necessary for obtaining the emission currents (vertical axis) shown in FIG. 6A. More specifically, in FIG. 6B, a line FN represents formula (2) described above, and other lines, i.e., $A_{IV21}$ (dotted line), $B_{IV21}$ (dash-dot line), $C_{IV21}$ (broken line), $A_{IV22}$ (thick dotted line), $B_{IV22}$ (thick dash-dot line), and $C_{IV22}$ (thick broken line) represent formula (3') for various parameter values.

If the driving voltage V and the resistance R of the resistor are given, the device voltage $V_f$ and the emission current $I_e$ are uniquely determined. If it is assumed that the driving voltage V does not depend on the temperature, the emission current $I_e$ is determined by the resistance R of the resistor. The resistance appears in formula (3') as 1/R which is a reciprocal of the absolute value of a coefficient of a variable $V_f$. In other words, the resistances are equal to the reciprocals of the gradients of the lines $A_{IV21}$, $B_{IV21}$. $C_{IV21}$, $A_{IV22}$, $B_{IV22}$, and $C_{IV22}$.

From the line $A_{IV21}$, it is possible to determine the driving voltage $V_{2a}$, the reference value $V_{f21}$ of the device voltage, and the resistance $R_{22a}$ of the resistor 3*a* that allow the emission current of the electron emission device 2 in the sub-pixel 6*a* to have the reference value $I_{e21}$ at the temperature $T_1$. The reference value $R_{21a}$ of the resistance of the resistor 3*a* corresponds to the gradient of the line $A_{IV21}$.

Similarly, from the line $B_{IV21}$, it is possible to determine the driving voltage $V_{2b}$, the reference value $V_{f21}$ of the device voltage, and the resistance $R_{22b}$ of the resistor 3*b* that allow the emission current of the electron emission device 2 in the sub-pixel 6*b* to have the reference value $I_{e21}$ at the temperature $T_1$. The reference value $R_{21b}$ of the resistance of the resistor 3*b* corresponds to the gradient of the line $B_{IV21}$.

From the line $C_{IV21}$, it is possible to determine the driving voltage $V_{2b}$, the reference value $V_{f21}$ of the device voltage, and the resistance $R_{22c}$ of the resistor 3*c* that allow the emission current of the electron emission device 2 in the sub-pixel 6*c* to have the reference value $I_{e21}$ at the temperature $T_1$. The reference value $R_{21c}$ of the resistance of the resistor 3*c* corresponds to the gradient of the line $C_{IV21}$.

To get the reference values for the emission currents, the driving voltages are set such that $V_{2a}>V_{2b}>V_{2c}$, because the resistances are such that $R_{22a}>R_{22b}>R_{22c}$.

From the line $A_{IV22}$, it is possible to determine the relative value $V_{f22a}$ of the device voltage and the relative value $R_{22a}$ of the resistance of the resistor 3*a*, that allow the emission current of the electron emission device 2 in the sub-pixel 6*a* to have the relative value $I_{e22a}$ at the temperature $T_2$ with respect to the reference value $T_{e21}$. The relative value $R_{22a}$ of the resistance of the resistor 3*a* corresponds to the gradient of the line $A_{IV22}$. Note that the driving voltage $V_{2a}$ is constant regardless of whether the temperature is at $T_1$ or $T_2$.

Similarly, from the line $B_{IV22}$, it is possible to determine the relative value $V_{f22b}$ of the device voltage and the relative value $R_{22b}$ of the resistance of the resistor 3*b* that allow the emission current of the electron emission device 2 in the sub-pixel 6*b* to have the relative value $I_{e22b}$ at the temperature $T_2$ with respect to the reference value $I_{e21}$. The relative value $R_{22b}$ of the resistance of the resistor 3*b* corresponds to the gradient of the line $B_{IV22}$. Note that the driving voltage $V_{2b}$ is constant regardless of whether the temperature is at $T_1$ or $T_2$.

From the line $C_{IV22}$, it is possible to determine the relative value $V_{f22c}$ of the device voltage and the relative value $R_{22c}$ of the resistance of the resistor 3*c* that allow the emission current of the electron emission device 2 in the sub-pixel 6*c* to have the relative value $I_{e22c}$ at the temperature $T_2$ with respect to the reference value $I_{e21}$. The relative value $R_{22c}$ of the resistance of the resistor 3*c* corresponds to the gradient of the line $C_{IV22}$. Note that the driving voltage $V_{2c}$ is constant regardless of whether the temperature is at $T_1$ or $T_2$.

In FIG. 6B, a solid circle on the line FN indicates the relationship between the device voltage and the emission current at the temperature $T_1$, and open circles indicate the relationship between the device voltage and the emission current at the temperature $T_2$.

The essence of the present embodiment of the invention is in that by increasing the emission current in response to increasing in temperature of the phosphor from $T_1$ to $T_2$ such that the emission current is increased more greatly for sub-pixels having phosphors with smaller temperature dependency of luminescent brightness, thereby suppressing the change in chromaticity of colors of pixels due to differences in temperature dependency of luminescent brightness of phosphors.

To increase the emission current at the phosphor temperature $T_2$ such that the emission current is increased more greatly for sub-pixels having phosphors with smaller temperature dependency of luminescent brightness, the gradients of lines $A_{IV22}$, $B_{IV22}$, and $C_{IV22}$ in FIG. 6B relative to the gradients of the lines $A_{IV21}$, $B_{IV21}$, and $C_{IV21}$ are increased in this order.

Figure 7:
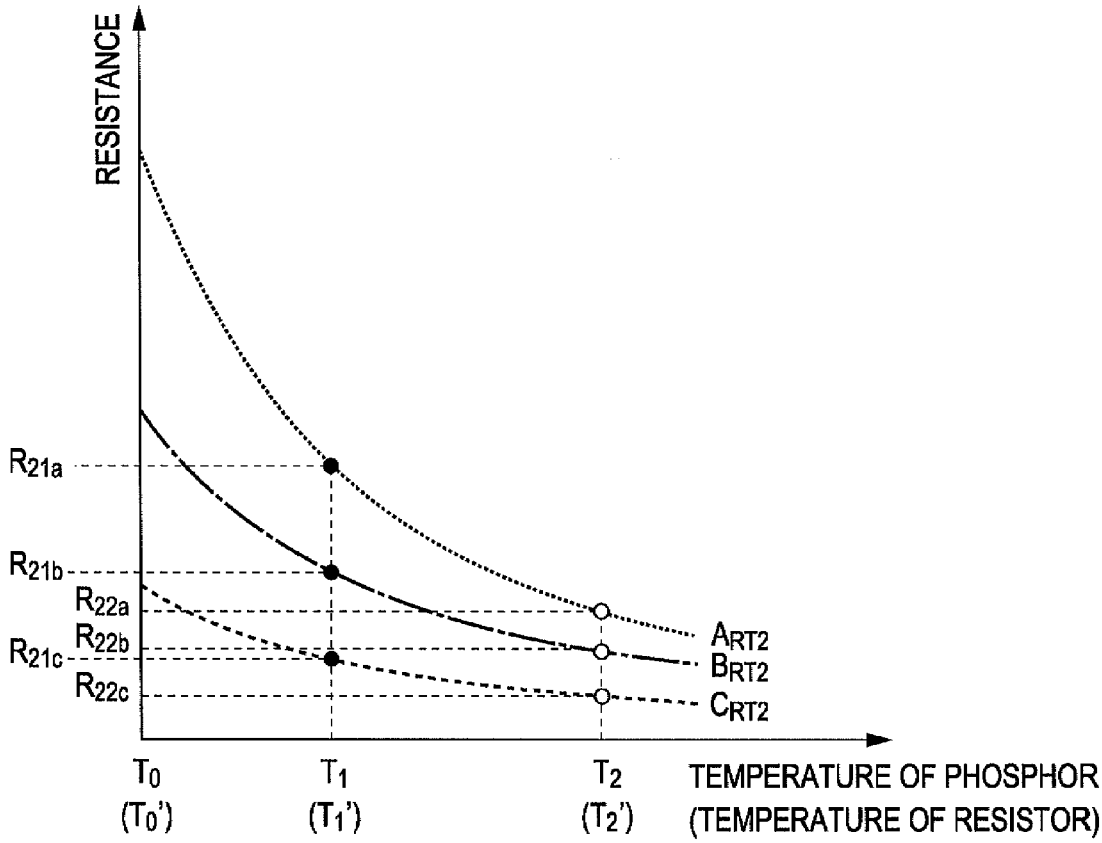
FIG. 7 is a graph representing temperature characteristics of resistance of resistors according to an embodiment of the present invention.

In FIG. 7, lines $A_{RT2}$, $B_{RT2}$, and $C_{RT2}$ indicate temperature characteristics of resistance when resistances of the resistors 3*a*, 3*b*, and 3*c* are set such that the resistance of the resistor 3*a*>resistance of the resistor 3*b*>resistance of the resistor 3*c*. In FIG. 7, a solid circle on the lines $A_{RT2}$, $B_{RT2}$, and $C_{RT2}$ indicates the resistance of the resistors at the temperature $T_1$, and open circles indicate the resistance of the respective resistors at the temperature $T_2$. $T_1'$ denotes the temperature of the resistor 3 when the phosphor 1 is at a temperature $T_1$, and $T_2'$ denotes the temperature of the resistor 3 when the phosphor 1 is at a temperature $T_2$. It is desirable that the temperature is equal for the phosphors and the resistors (i.e., $T_1=T_1'$ and $T_2=T_2'$). However, even if the temperature is different between the phosphors and the resistors, the change in phosphor temperature is mainly caused, as described above, the change in environmental temperature when the driving voltage is constant, and thus the temperature of the resistance also changes according to the environmental temperature.

Because the resistors 3*a*, 3*b*, and 3*c* are made of the same material, the activation energy $E_a$ is equal for all resistors 3*a*, 3*b*, and 3*c*. According to formula (5), the relative values of the resistances of the resistors at temperature $T_2$, and reference values of the resistances of the resistors at temperature $T_1$ have the following relationship: $R_{21a}>>>R_{22a}$, $R_{21b}>>R_{22b}$, $R_{21c}>R_{22c}$.

In FIG. 6B, the gradients of the respective lines at the temperature $T_1$ are $A_{IV21}$: $1/R_{21a}$, $B_{IV21}$: $1/R_{21b}$, and $C_{IV21}$: $1/R_{21c}$, and the absolute values of the gradients of the respective lines at the temperature $T_2$ are $A_{IV22}$: $1/R_{22a}$, $B_{IV22}$: $1/R_{22b}$, and $C_{IV22}$: $1/R_{22c}$. Therefore, in FIG. 6B, $C_{IV22}<B_{IV22}<A_{IV22}$ can be achieved in terms the gradients of the lines at the temperature $T_2$.

Therefore, when the phosphor temperature increases from $T_1$ to $T_2$, the emission current increases by a greater factor for a sub-pixel having a phosphor with a smaller temperature dependency of luminescent brightness, thereby making it possible to reduce the change in chromaticity of color of each pixel.

According to the operation of the first or second embodiment of the present invention, when the temperature of the phosphors increases from $T_1$ to $T_2$, the change in the chromaticity of color of the pixels is minimized. It is clear that when the temperature of the phosphors decreases from $T_1$ to $T_2$, the operation of the first or second embodiment minimizes the change in the chromaticity of color of the pixels.

In practice, $T_0$, $T_1$, and $T_2$ may be set depending on the range of temperature (usually, room temperature) of an environment in which the image display apparatus is used. In the image display apparatus according to the embodiments of the present invention, irradiation of electrons to the phosphors 1 causes the phosphors 1 to be heated, and thus the temperature of the phosphors is generally higher than the environmental temperature. Thus, the temperature of the phosphors generally becomes higher by a few ten K than the environmental temperature, although the specific amount of increase depends on the structure of the image display apparatus. Therefore, it is desirable to determine $T_0$, $T_1$, and $T_2$ taking into account the heating of the phosphors 1 in addition to the environmental temperature.

In the above description, for simplicity, the device currents at temperature $T_1$ are expressed using the reference values such as $I_{e11}$, $I_{21}$, etc. The ratio of the emission currents of the sub-pixels 6*a*, 6*b*, and 6*c* at $T_1$ may be properly set. The emission currents may be set such that the emission currents are equal for all sub-pixels in each pixel. More specifically, in the first embodiment, the resistances of the resistors 3*a*, 3*b*, and 3*c* may be set to be equal to each other at $T_1$, and the driving voltage may also be set to be equal for all sub-pixels in each pixel. Alternatively, the resistors 3*a*, 3*b*, and 3*c* may be set to have different resistances and the driving voltages may be set to be different. In this case, it is desirable that resistances are set such that the resistance of the resistor 3*a*>the resistance of the resistor 3*b*>the resistance of the resistor 3*c*. In the second embodiment, actual values of the driving voltage may be set such that the driving voltage for the sub-pixel 6*a*>the driving voltage for the sub-pixel 6*b*>the driving voltage for the sub-pixel 6*c*.

The ratio of the emission currents of the sub-pixels 6*a*, 6*b*, and 6*c* at $T_1$ may be set differently, for example, such that the white color provided by the pixel 7 has a particular color temperature. More specifically, in the first embodiment, the resistances of the resistors 3*a*, 3*b*, and 3*c* may be set to be equal to each other at $T_1$, while the driving voltages may be set to different values. Alternatively, the driving voltages may be set to the same value, while the resistances of the resistors 3*a*, 3*b*, and 3*c* may be set to different value at $T_1$. In this case, it is desirable that resistances are set such that the resistance of the resistor 3*a*>the resistance of the resistor 3*b*>the resistance of the resistor 3*c*. In the second embodiment, the driving voltages may be set to the same value or different values.

As described above, the present invention may be modified in various manners without departing from the scope of the present invention as defined by the appended claims.

Figure 8:
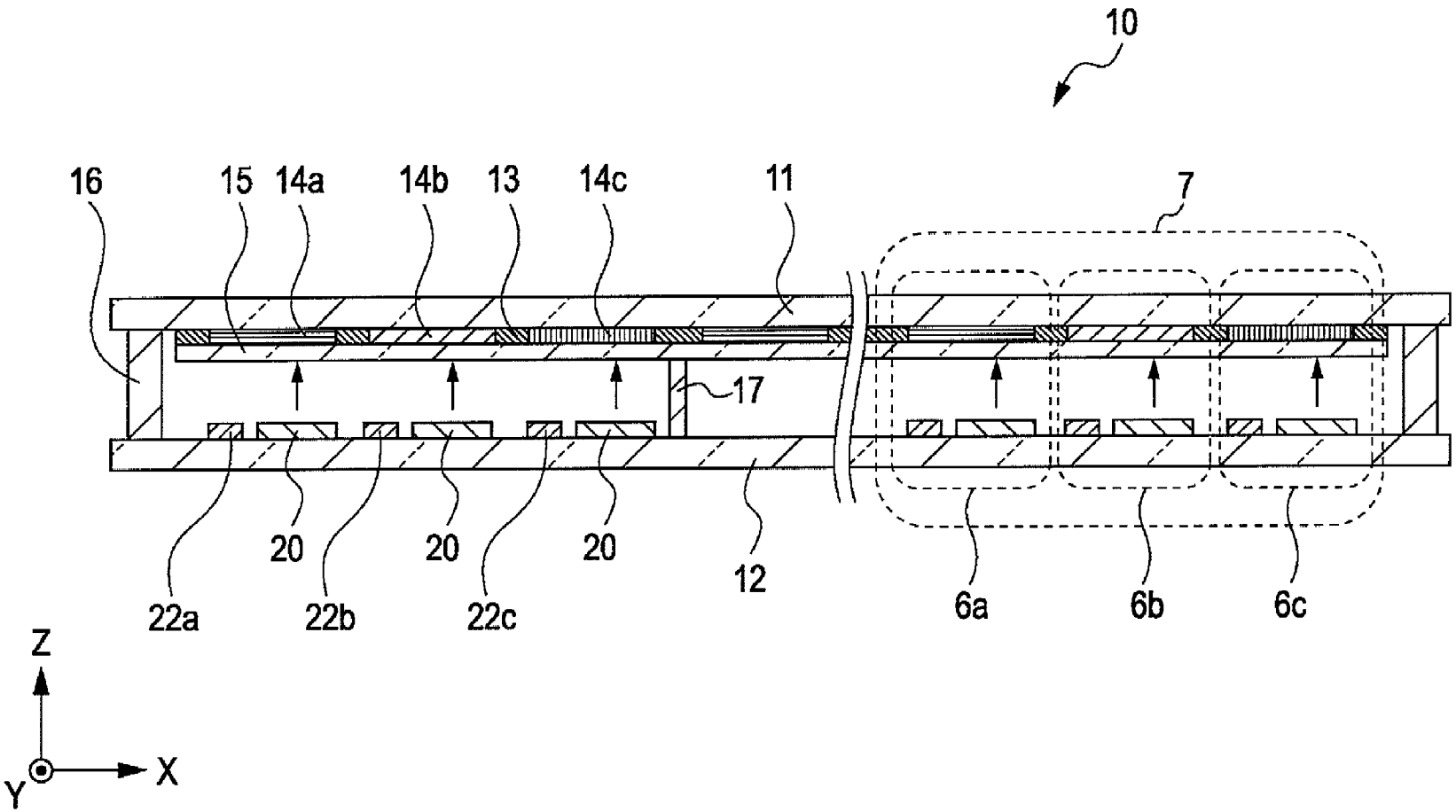
FIG. 8 is a diagram schematically illustrating a cross section of an image display apparatus of a flat panel type.

Now, the image display apparatus according to the present invention is described in further detail below in terms of the configuration thereof. FIG. 8 is a diagram schematically illustrating a typical image display apparatus 10 of a flat panel type. In a left-hand area (as seen in an X direction) of FIG. 8, elements of the image display apparatus 10 are shown, while blocks of elements are shown in a right-hand area.

Reference numeral 11 denotes a face plate including a plurality of types of phosphors 14 (14*a*, 14*b*, and 14*c*).

The face plate 11 also includes a light shielding member 13 disposed between the phosphors 14*a*, 14*b*, and 14*c*, and the face plate 11 also includes an anode 15.

Reference numeral 12 denotes a rear plate, and reference numeral 20 denotes an electron emission device. The rear plate 12 includes a plurality of electron emission devices 20. The rear plate 12 also includes a plurality of resistors 22*a*, 22*b*, and 22*c*. Each of the resistors 22*a*, 22*b*, and 22*c* is connected to a corresponding electron emission device 20 in a manner described later with reference to FIGS. 10 and 11. In addition to the electron emission devices 20 and the resistors 22, the rear plate 12 also includes electrodes and wirings 4 for driving the electron emission devices 20.

The face plate 11 and the rear plate 12 are disposed such that the electron emission devices 20 face the phosphors 14. Reference numeral 16 denotes a frame that forms, together with the two plates described above, an envelope the inside of which is maintained under vacuum. Reference numeral 17 denotes a spacer (a member in the form of a plate, a column, a rib, or the like) disposed between the face plate 11 and the rear plate 12 and functioning as a structure that allows these two plates to be spaced apart by a predetermined distance.

Electrons emitted by each electron emission device 20 are accelerated to predetermined energy by a positive voltage (for example, in a range from +5 kV to +15 kV) applied to the anode 15 disposed on the face plate 11. The accelerated electrons strike corresponding phosphors 14 thereby exciting the phosphors 14 such that light is emitted from the phosphors 14. The light emitted from the phosphors 14 can be observed via the face plate serving as a display plate.

As described above, the face plate 11 having the phosphors 14 and the rear plate 12 having the electron emission devices 20 are disposed such that they face each other, and the internal space between them is maintained under vacuum (for example, at a pressure of $1\times10^{-5}$ Pa or lower). Thus, a change in temperature of the phosphors 14 disposed on the face plate 11 exposed in the form of the display plate is mainly caused by a change in temperature of an environment in which the image display apparatus 10 is installed. Therefore, the temperature of the resistors 22 disposed on the rear plate 12 also changes with the change in the environmental temperature, and thus the advantages of the present embodiment of the invention can be achieved.

A combination of one phosphor 14*a*, one electron emission device 20, and one resistor 22*a* forms one sub-pixel 6*a*, a combination of one phosphor 14*b*, one electron emission device 20, and one resistor 22*b* forms one sub-pixel 6*b*, and a combination of, one phosphor 14*c*, one electron emission device 20, and one resistor 22*c* forms one sub-pixel 6*c*.

A combination of sub-pixels 6*a*, 6*b*, and 6*c* located adjacent to each other forms one pixel 7. Therefore, the temperature can be regarded as being equal at least for the components of sub-pixels in one pixel.

The image display apparatus 10 includes a plurality of pixels 7. Note that only part of the pixels 7 are shown in FIG. 8. Although only two pixels 7 are shown in FIG. 8, the image display apparatus 10 may include a large number of pixels. For example, to implement an image display apparatus according to the HDTV standard, pixels 7 are arranged in the form of a 1080 (vertical)×1920 (horizontal) array, and thus the image display apparatus includes a total of 2 million or more pixels 7.

A driving unit (not shown) for driving the image display apparatus 10 is disposed outside the envelope. The image display apparatus 10 is disposed in a housing (not shown). In the inside of the housing, there may be further disposed a signal processing unit to process an image signal to be displayed. There may be further disposed one or more other components such as a tuner for receiving a television broadcast signal, a storage unit for storing the image signal, a decoder for converting image/text information obtained from the outside into an image signal, etc.

Figure 9:
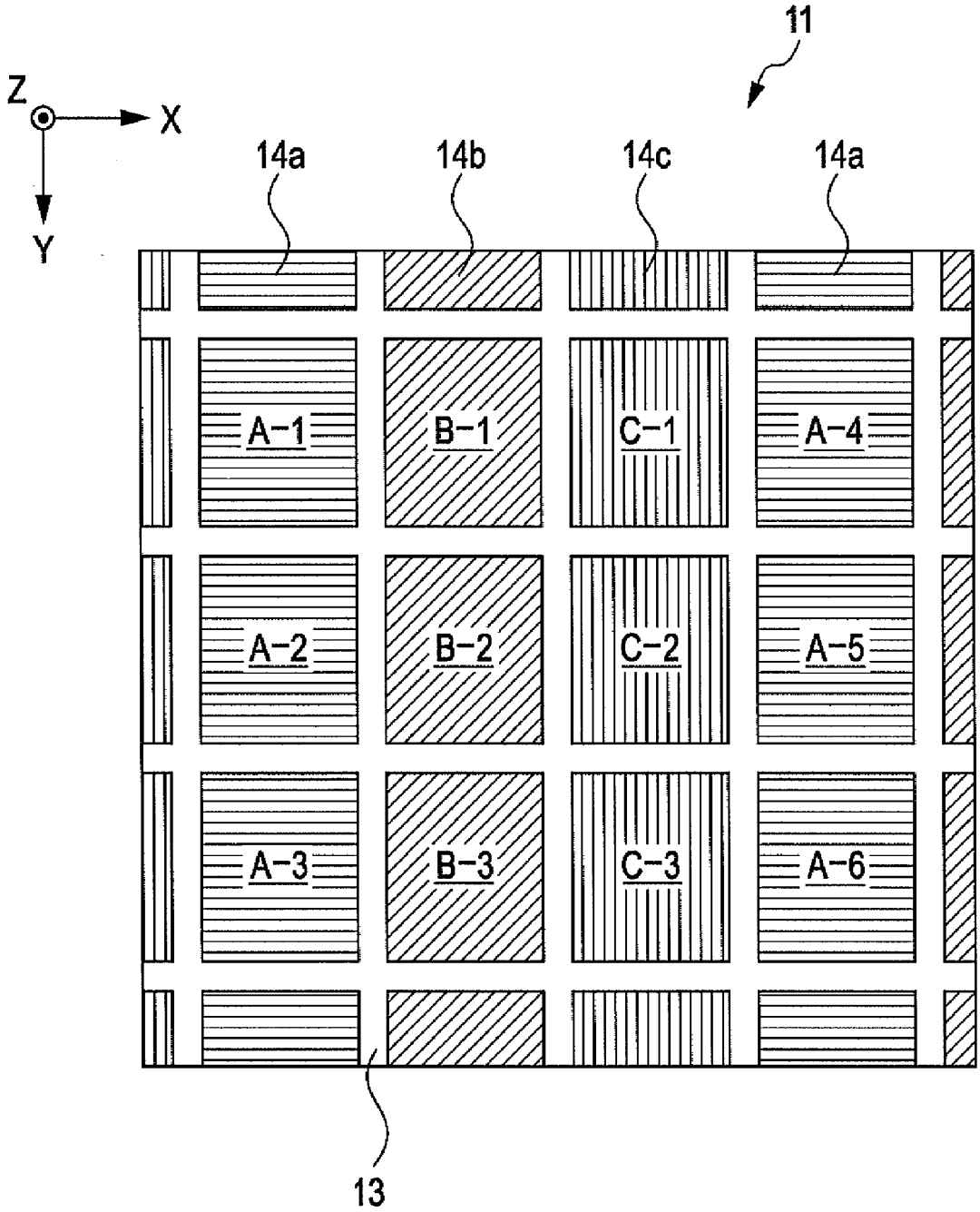
FIG. 9 is a schematic plan view partially illustrating a face plate.

FIG. 9 illustrates a structure of the face plate 11 on which a plurality of phosphors are disposed. In FIG. 9, phosphors 14*a* emit red light, phosphors 14*b* emit green light, and phosphors 14*c* emit blue light. By arranging the phosphors 14*a*, 14*b*, and 14*c* in the form of an array on the face plate 11, a display plane is formed.

Examples of materials of the phosphors 14 include $SrTiO_3$:Pr, $Y_2O_3$:Eu, $Y_2O_2S$:Eu, (Y,Gd)$BO_3$:Eu, etc., for the phosphors 14*a* that emit red light, $Zn(Ga,Al)_2O_4$:Mn, $Y_3(Al,Ga)_5O_{12}$:Tb, $Y_2SiO_5$:Tb, ZnS:Cu, Al, $Zn_2SiO_4$:Mn etc., for the phosphors 14*b* that emit green light, and $Y_2SiO_5$:Ge, $ZnGa_2O_4$, ZnS:Ag, Cl, GaN:Zn, $BaMgAl_{.0}O_{17}$:Eu, etc. for the phosphors 14*c* that emit blue light.

In the example shown in FIG. 9, phosphors 14 are arranged in an X direction in the order phosphor 14*a*, phosphor 14*b*, phosphor 14*c*, while phosphors 14 are arranged in an Y direction such that the color is the same for each column in the Y direction. Note that the manner in which the phosphors 14 are arranged is not limited to this example, but they may be arranged in various different manners.

The light shielding member 13 is typically a black matrix including a light shielding part made of a black material and also including a plurality of openings into which the face plate is divided and through which light is allowed to pass to the outside. Each opening may be formed in the shape of a rectangle as with example shown in FIG. 9, or in other shapes such as a circle, an ellipse, a polygon, etc. The black matrix 13 is positioned such that the phosphors 14*a*, 14*b*, and 14*c* with different colors are isolated from each other, and pixels in the Y direction are isolated from each other. Advantages provided by the black matrix 13 include an improvement in contrast of a displayed image, absorption of external light thereby reducing reflection of light at the display plane, etc. The phosphors 14*a*, 14*b*, and 14*c* are disposed at least within areas whose boundaries are defined by the openings of the black matrix. Thus, a phosphor forming one sub-pixel can be clearly perceived as being located in corresponding one area defined by the black matrix 13.

A conductive layer serving as the anode 15 is disposed on the face plate 11. The anode 15 may be disposed on the upper side (on the side of the rear plate, i.e., on the −z side) of the phosphor 14 or on the lower side (on the side of the face plate, i.e., on the +z side) of the phosphor 14. In the case where the anode 15 is disposed on the side of the rear plate 12, it is desirable that the anode 15 is made of a metal material such that it can also be used as a light reflecting film. In the case where the anode 15 is disposed on the side of the face plate 11, the anode 15 should be constructed in the form of a film transparent to visible light. A color filter (not shown) may be disposed on the side (+z side) of the phosphor 14 toward the outside thereby enhancing color purity of luminescent color of the sub-pixel. In this case, the color filter may be disposed in the area within the opening and between the phosphor 14 and a substrate.

Figure 10:
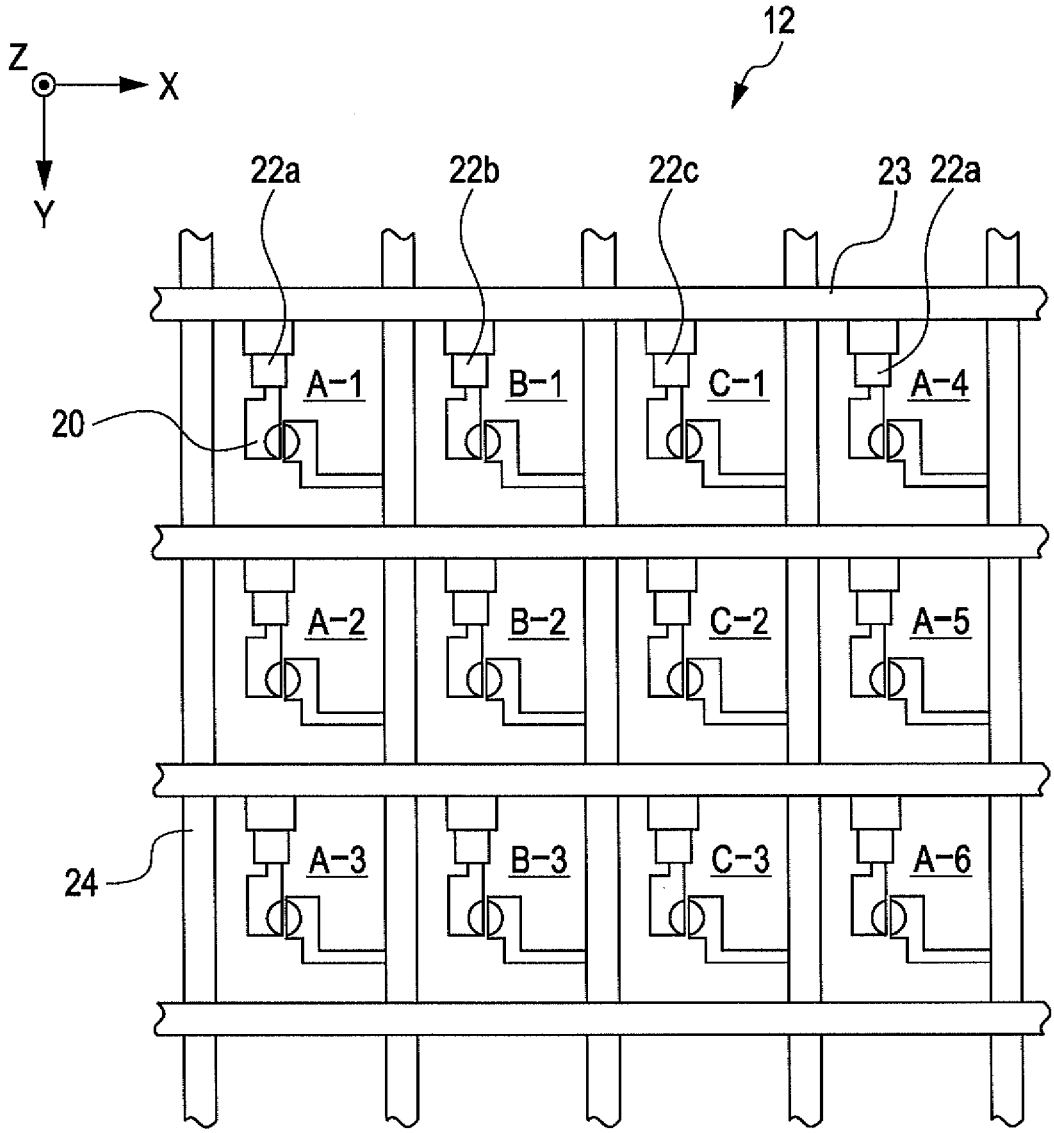
FIG. 10 is a schematic plan view partially illustrating a rear plate.

The relationship between the plurality of electron emission devices disposed on the rear plate 12 and the resistors connected in series to the corresponding electron emission devices shown in FIG. 8 is described in detail below with reference to FIG. 10 and FIG. 11. FIG. 10 illustrates surface conduction type electron emission devices 20 used as the electron emission devices 20 disposed on the rear plate 12 shown in FIG. 8. In FIG. 10, reference numeral 20 denotes a surface conduction type electron emission device, reference numerals 22*a*, 22*b*, and 22*c* denote resistors, reference numeral 23 denotes a first wiring extending in an X direction, and reference numeral 24 denotes a second wiring extending in a Y direction. Ideally, the plurality of electron emission devices 20 are formed so as to have the same characteristics. However, in practice, there can be differences in characteristics among the electron emission devices 20. There are two types of wirings, i.e., the first wiring 23 and the second wiring 24. The first wiring 23 and the second wiring 24 are applied with different voltages such that the voltage difference between them is supplied to the electron emission device 20. That is, the electron emission device 20 is driven via the passive matrix wiring system. The first wiring 23 is a scanning wiring for transmitting a scanning signal to select an X row to be driven, and the second wiring 24 is an information wiring for transmitting an information signal to be applied to the electron emission device 20.

N×M electron emission devices 20 are formed on the rear plate 12. The N×M electron emission devices 20 are connected via M X direction wirings 23 and N Y direction wirings 24 arranged in the form of the passive matrix wiring system. In FIG. 10, only 3×3 electron emission devices 20, i.e., only a total of 9 electron emission devices 20 are shown.

Figure 11:
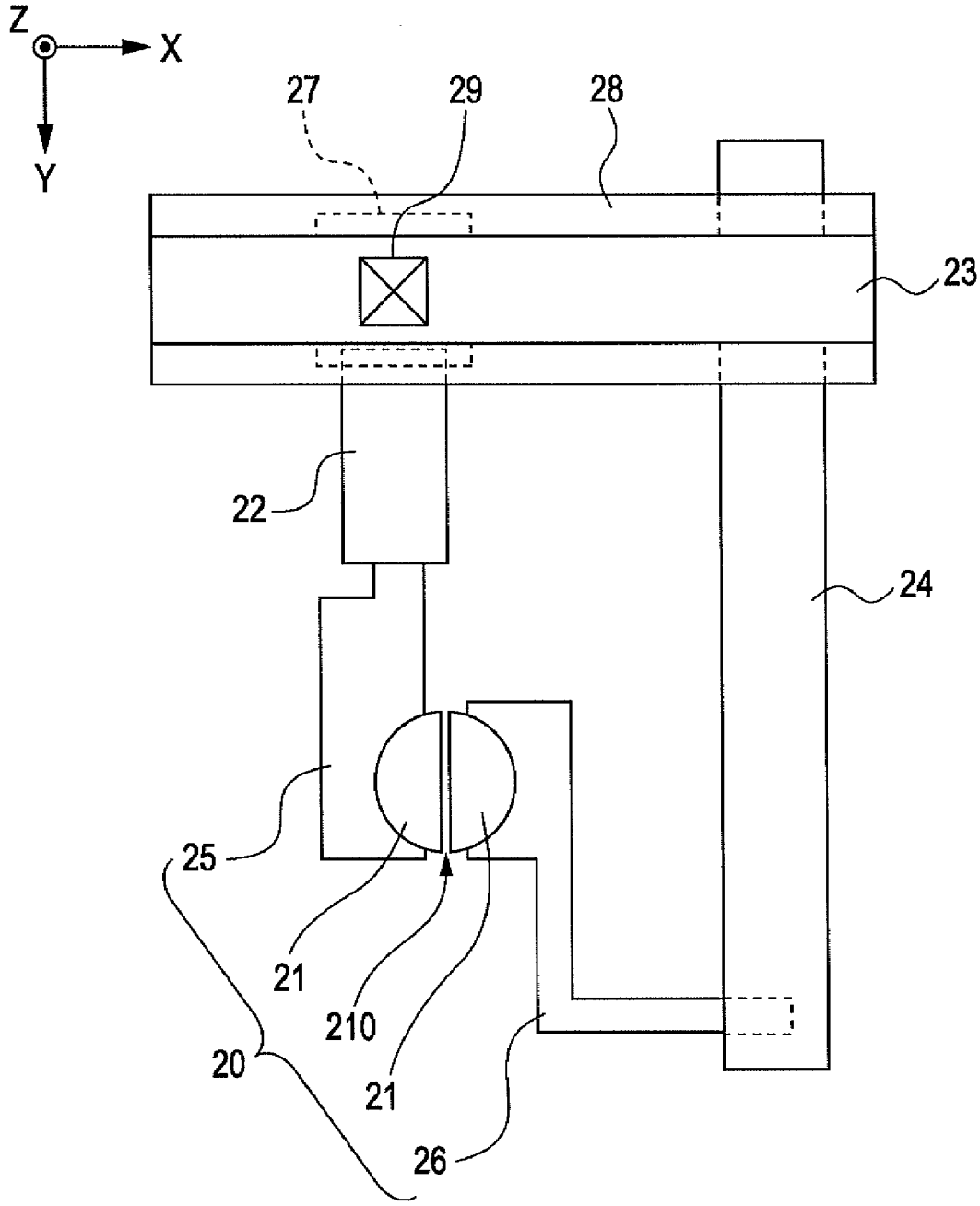
FIG. 11 is a schematic diagram illustrating a structure of a sub-pixel including an electron emission device and a resistor.

FIG. 11 illustrates one sub-pixel including one electron emission device 20 and a resistor 22 (22*a*, 22*b*, or 22c) and also illustrates wirings for driving the sub-pixel. The electron emission device 20 includes an electron emission film 21, a scanning signal device electrode 25, and an information signal device electrode 26. The electron emission film 21 has a gap 210. If the scanning signal device electrode 25 is applied with a low electric potential (for example, in a range of −20 V to 0V), and the information signal device electrode 26 is applied with a high electric potential (for example, in a range of 0 V to +10V), an electric field appears in the gap 210 of the electron emission film 21, and electrons are emitted. That is, a part of the electron emission film 21 connected to the scanning signal device electrode 25 functions as a cathode, and a part of the electron emission film 21 connected to the information signal device electrode 26 functions as a gate.

One end of the resistor 22 is connected in series to the electron emission device 20. The scanning signal device electrode 25 and the information signal device electrode 26 are connection members with low resistance and with shapes that allow easy connections between the one end of the resistor 22 and the electron emission device 20 and between the electron emission device 20 and the second wiring 24. The other end of the resistor 22 is connected in series to the first wiring 23 via an extension wiring 27. The extension wiring 27 is also a connection member with low resistance and with a shape that allows an easy connection between the resistor 22 and the first wiring 23.

Reference numeral 28 denotes an insulating layer for ensuring electrical insulation between the first wiring 23 and the second wiring 24 at an intersection between them. Note that part of the insulating layer 28 lies between the extension wiring 27 and the first wiring 23. The extension wiring 27 connected to the electron emission device 20 via the resistor 22 is connected to the first wiring 23 via a contact hole 29 formed in the insulating layer 28.

The resistor 22 is described in further detail below. As described above, it is desirable that the resistance of the resistor 22 is equal to or greater than 100 Ω. Because the electron emission devices are produced basically by a microfabrication process, it is also desirable that the resistors are formed in the shape of a thin film (with a thickness less than 10 μm). In this case, to achieve the resistance described above, it is desirable to use a material with a volume resistivity equal to or greater than $10^{-3}$ Ωm or a material with a thickness equal to or greater than 1 μm and with a sheet resistance of 1 kΩ/square.

In general, materials with great volume resistivities are semiconductors and many of them have negative temperature characteristic of resistance. In particular, to obtain a high resistance by reducing t and/or w, a high volume resistivity $\rho_1$ is necessary. In general, materials having high volume resistivities have high activation energy and thus exhibit large reductions in volume resistivity with increasing temperature. The resistors may be formed using a wide variety of materials such as Si or a-Si, Si—C, TaN, amorphous carbon, DLC, cermet, silicide, oxide semiconductor, nitride semiconductor, ATO (antimony tin oxide), $SnO_2$, WGeON, PtAlN, AlN, ZnO, etc. The resistors may be formed using a plurality of materials selected from the above-described material. In this case, the resistors may include a plurality of parts formed of different materials. For example, the resistors may be formed in a multilayer structure by depositing different materials layer by layer. Most materials described above have semiconductor-like characteristics and have a negative temperature characteristic of resistance. For example, typical activation energy $E_a$ thereof is as follows: 0.05 eV for AuSiON, 0.1 eV for PtAlN, 0.14 eV for TaN, 0.3 eV for WGeON, and 0.8 eV for a-Si. These materials can have a desirable volume resistivity by properly selecting film formation conditions (for example, composition ratio). The thin-film resistors may be formed using a vacuum film formation process such as vacuum evaporation, sputtering, and plasma CVD, or by using other various techniques such as a spin-coating technique, a spraying technique, etc.

As explained in the first embodiment, activation energy different among resistors 22*a*, 22*b*, and 22*c* can be achieved by properly selecting materials and/or compositions of materials for the respective resistors depending on the activation energy to be achieved. In the case where resistors are formed in a structure using a plurality of materials, it is possible to control the activation energy so as to have different activation energy by adjusting the composition of materials.

On the other hand, as explained above in the second embodiment, resistors 22*a*, 22*b*, and 22*c* formed of the same material and having different resistances can be obtained by adjusting the dimension (for example, width, length, thickness) of the resistors 22*a*, 22*b*, and 22*c* according to formula (6). Substantially different width and/or the length may be obtained by forming the resistors in a zigzag shape or by providing a slit in part of the resistors. Alternatively, a contact area between an electrode and a wiring may be changed depending on the resistors 22*a*, 22*b*, and 22*c*. These methods may also be employed in the first embodiment to obtain different resistances at the temperature $T_1$.

In FIG. 9, addresses (A-1 to A-6, B-1 to B-3, C-1 to C-3) assigned to the phosphors 14*a*, 14*b*, and 14*c* disposed on the face plate 11 correspond to addresses (A-1 to A-6, B-1 to B-3, C-1 to C-3) shown in FIG. 10. The face plate 11 and the rear plate 12 are positioned such that the addresses shown in FIG. 9 and the addresses shown in FIG. 10 correctly correspond to each other, thereby forming the envelope of the image display apparatus. Thus, a first pixel includes a sub-pixel A-1, a sub-pixel B-1, and a sub-pixel C-1, a second pixel includes a sub-pixel A-2, a sub-pixel B-2, and a sub-pixel C-2, and a third pixel includes a sub-pixel A-3, a sub-pixel B-3, and sub-pixel C-3.

The present invention is described in further detail below with reference to specific examples. Note that these examples are given merely by way of examples, but not by way of limitation.

FIRST EXAMPLE

Methods of producing components of an image display apparatus such as that shown in FIG. 8 are described below.

Producing Face Plate

First, a method of producing a face plate 11 is described below with reference to FIG. 8 and FIG. 9. In FIG. 8, reference numeral 13 denotes a black matrix, and reference numerals 14*a*, 14*b*, and 14*c* denote phosphors having different luminescent colors.

Producing Black Matrix

PD-200 was used for the substrate of the face plate 11. A pattern of black pigment paste was printed over the surface of the substrate by using a screen printing technique, and baking was performed thereby forming the black matrix 13 including openings disposed in the form of an array with 3072 elements arranged in an X direction and 768 elements arranged in a Y direction. The width, as measured in the X direction, of each opening of the black matrix 13 was set to 150 μm, and the width as measured in the Y direction was set to 300 μm. The width of the black matrix 13 was set to 50 μm in the X direction and 300 μm in the Y direction.

Forming Phosphor

Figure 12:
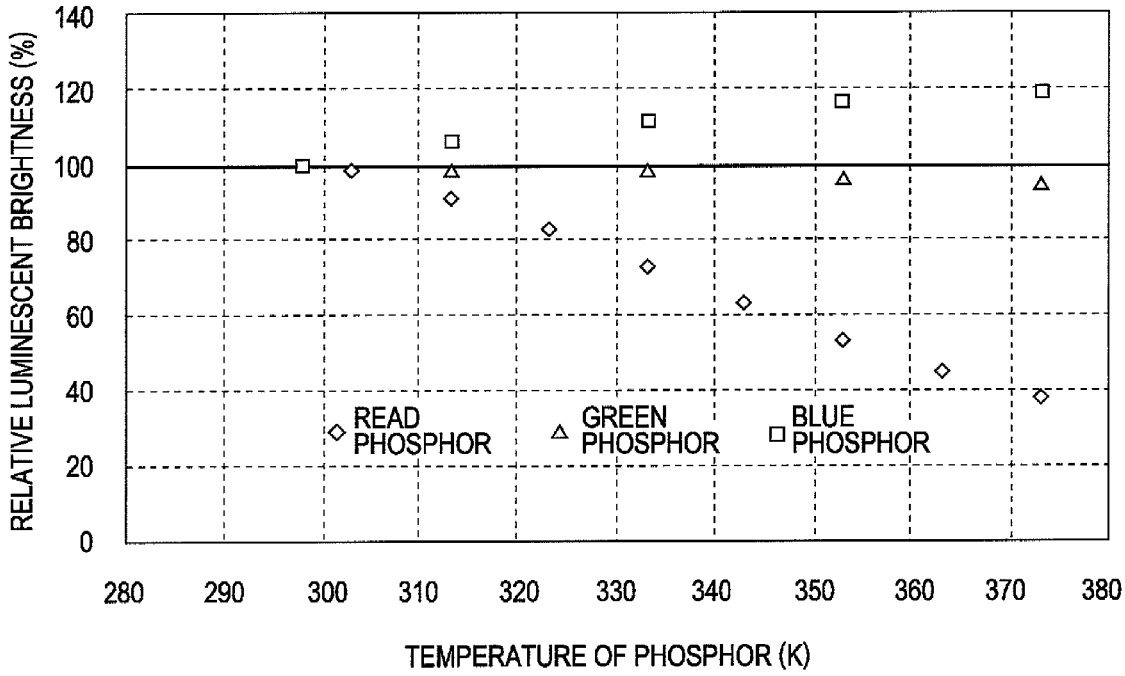
FIG. 12 is a graph showing temperature dependency of luminescent brightness of P22 phosphors.

As for the phosphor, P22 phosphors of three primary colors, i.e., red, green, and blue, which are used in the field of CRT technology were employed. More specifically, red $Y_2O_2S$:Eu was used for the phosphors 14*a*, green ZnS:Cu,Al was used for the phosphors 14*b*, and blue ZnS:Ag was used for the phosphors 14*c*. FIG. 12 illustrates temperature dependency of luminescent brightness of P22 phosphors. In FIG. 12, luminescent brightness at phosphor temperature $T_1$=298 K is taken as a reference value (100%), and relative luminescent brightness with respect to the reference value is plotted over a range to phosphor temperature of 373 K. γ indicating the gamma characteristic of the P22 phosphors was as follows: 0.85 for phosphors 14*a* (red), 0.67 for the phosphors 14*b* (green), and 0.75 for the phosphors 14*c* (blue).

The phosphor materials in the form of paste were applied to the inner area of each opening of the black matrix 13 by a screen printing technique, and baking was performed thereby forming the phosphors 14*a*, 14*b*, and 14*c*.

Forming Anode

The surfaces of the phosphors 14*a*, 14*b*, and 14*c* were smoothed using a filming method which is widely used in the CRT technology, and aluminum was then vacuum-evaporated thereon to a thickness of 100 nm thereby forming a back metal film functioning as an anode 15.

The face plate 11 was obtained via the process described above.

Producing Rear Plate

Next, a method of producing a rear plate 12 is described below. A typical method of disposing an array of electron emission devices 20 shown in FIG. 8 is the passive matrix arrangement. In this method, as described above with reference to FIG. 2A, one of two device electrodes of each electron emission device 20 is connected to an X wiring, and the other one of the two device electrodes is connected to a Y wiring.

FIG. 10 is a plan view partially illustrating the rear plate 12. On this rear plate 12, there are formed 3072×768 electron emission devices 20 that are connected via the passive matrix wirings including 3072 X wirings 23 and 768 Y wirings 24.

In the present example, as for each of the electron emission devices 20 of the rear plate 12 shown in FIG. 8, the electron emission device 20 having the structure shown in FIG. 11 was employed. A method of forming the electron emission devices 20 and associated wirings on the rear plate 12 is described below. Although the following explanation is in terms of only one electron emission device 20, a plurality of electron emission devices 20 and associated wirings including X wirings 23 and Y wirings for common use were produced at the same time in the actual process.

Forming Device Electrode

A glass substrate PD-200 (available from Asahi Glass Co., Ltd.) with a thickness of 2.8 mm was prepared, a $SiO_2$ film with a thickness of 200 nm was formed on the glass substrate by a coating technique. A Ti film with a thickness of 5 nm and a Pt film with a thickness of 20 nm were then formed in this order on the glass substrate. Next, using a photolithography technique, the Pt/Ti film was patterned to form the scanning signal device electrode 25 and the information signal device electrode 26. The volume resistivity of these device electrodes 25 and 26 was $2.5\times10^{-7}$ (Ωm). In the scanning signal device electrode 25, a width was set to 20 μm for a part that was going to be brought, in a following process, into contact with the electron emission film 21, and a width was set to 10 μm for a part that was going to be brought into contact with the resistor 22.

Forming Resistor

Next, the resistors 22*a*, 22*b*, and 22*c* were formed in this order. The activation energy of the resistors was set such that the activation energy of the resistor 22*a*>the activation energy of the resistor 22*b*>the activation energy of the resistor 22*c*. In the determination of the activation energy, the phosphor temperatures $T_0$, $T_1$, and $T_2$ were assumed to be equal to an environmental temperature+25° C., and the resistor temperatures $T_0'$, $T_1'$, and $T_2'$ were assumed to be equal to the environmental temperature +15° C.

In the present example, the resistors 22*a*, 22*b*, and 22*c* were formed so as to have the same shape, and the composition of the resistor materials was selected such that the resistor materials had the same volume resistivity. In this structure formed by the above process, because there is no difference among sub-pixels in each pixel except for the phosphors and resistors, it is possible to minimize the unevenness of the luminescent characteristics among the sub-pixels. By using the same photomask, it is also possible to reduce the production cost.

More specifically, first, a WGeON film was formed by performing sputtering using W and Ge as targets in a nitrogen ambient including a small amount of oxygen. Thereafter a sequence of photolithography processes and RIE (reactive ion etching) processes were performed to form a predetermined pattern of the WGeON film. Then a resist was removed. As a result, the resistor 22*a* was obtained. The activation energy of the WGeON film was 0.3 eV, and the volume resistivity at a resistor temperature $T_1'$=315 K was 75 Ωm. When the film thickness was set to 50 nm, the resistance at the resistor temperature $T_1'$=315 K was $1.5\times10^4$ Ω.

Next, a PtAlON film was formed by performing sputtering using Pt and Al as targets in a nitrogen ambient including a small amount of oxygen. Thereafter a sequence of photolithography processes and RIE processes were performed to form a predetermined pattern of the PtAlON film. Then a resist was removed. As a result, the resistor 22*b* was obtained. The activation energy of the PtAlON film was 0.1 eV, and the volume resistivity at 300 K was 75 Ωm. When the film thickness was set to 50 nm, the resistance at 300 K was $1.5\times10^4$ Ω.

Finally, an AuSiON film was formed by performing sputtering using Au and Si as targets in a nitrogen ambient including a small amount of oxygen. Thereafter a sequence of photolithography processes and RIE processes were performed to form a predetermined pattern of the AuSiON film. Then a resist was removed. As a result, the resistor 22*c* was obtained. The activation energy of the AuSiON film was 0.05 eV, and the volume resistivity at a resistor temperature $T_1'$=315 K was 75 Ωm. When the film thickness was set to 50 nm, the resistance at the resistor temperature $T_1'$=315 K was $1.5\times10^4$ Ω.

Forming Information Signal Wiring and Extension Wiring

The information signal wiring 24 and the extension wiring 27 were formed by a screen printing process using a silver paste. The thickness and the width of the information signal wiring 24 were set to about 10 μm and 20 μm, respectively.

Forming Insulating Layer

The insulating layer 28 with a thickness of 30 μm and a width of 200 μm, which would lie below the scanning signal wiring 23 to be formed later in a following process, by a screen printing process using an insulating paste. In the insulating layer 28, the opening 29 was formed in a part of an area where the insulating layer 28 overlaps the extension wiring 27.

Forming Scanning Signal Wiring

The scanning signal wiring 23 with a thickness of 10μ and a width 150 μm was formed on the insulating layer 28 by a screen printing process using silver paste. In this process, a lead wiring for a connection to an external driving circuit and a lead terminal where also formed in a similar manner although they are not shown in the figures.

Forming Electron Emission Part

Using an ink-jet coating apparatus, a solution including organic palladium was applied to a dot with a diameter of 50 μm between the device electrodes 25 and 26. Thereafter, baking was performed in the air. As a result, a palladium oxide (PdO) film with a maximum thickness of 10 nm was obtained.

A current was passed through the palladium oxide film in an ambient including hydrogen gas such that the palladium oxide was reduced thereby forming an electron emission film 21 of palladium having a crack formed in part of the electron emission film 21.

An activation process was then performed by passing a current through the electron emission film 21 in an ambient at a pressure of $1.3\times10^{-4}$ Pa, and a carbon film was deposited thereon. As a result, the electron emission device 20 having the gap 210 was obtained.

Producing Display Panel

Finally, as shown in FIG. 8, the frame 16 was disposed such that it surrounded the periphery of the produced face plate 11 and the rear plate 12, and was sealed in vacuum while maintaining the distance between the two plates at 2 mm using a spacer 17. Via the process described above, a flat display panel having 1024×768 pixels arranged in a pitch of 600×600 μm was obtained.

Evaluation

A known driving apparatus serving as the driving unit 5 was connected to the image display panel to obtain an image display apparatus. Using a driving apparatus, −17.5 V was applied to the scanning signal wiring 23 connected to the respective sub-pixels in one pixel, and +10 V was applied to the information signal wirings 24 at the same time thereby simultaneously driving the respective sub-pixels in the one pixel such that the same emission current was obtained for all sub-pixels. As a result, a device current of 100 μA was observed for all sub-pixels. A high voltage of +10 kV was applied to the back metal film 15 of the face plate 11 via a high voltage terminal. In this situation, the environmental temperature was 300 K, the temperature of the face plate 11 was 325 K, and the temperature of the rear plate 12 was 315 K. In response to the application of the voltages described above, all sub-pixels emit light simultaneously. The color observed as a whole of light emitted from the sub-pixels of one pixel was white. No unevenness of brightness across the display screen was observed. Under the driving conditions described above, color temperature was measured using a luminance colorimeter (BM-7 (available from Topcon techno house corporation). The measured color temperature was about 12000 K. In an environmental test room, a change in color temperature was measured over a range of environmental temperature from 280 K (7° C.) to 320 K (47° C.). A measurement result is shown in FIG. 13. A change in color temperature in a range of 12000 to 14000 K was observed when the environmental temperature was changed over a range from 280 to 320 K. At temperatures lower than 300 K, substantially no change in color temperature was observed, and the color temperature was about 12000 K.

SECOND EXAMPLE

Next, a second example is described. In the second example, the resistors 22*a*, 22*b*, and 22*c* of the respective sub-pixels were formed using the same material such that the resistance of the resistor 22*a*>the resistance of the resistor 22*b*>the resistance of the resistor 22*c*. In the setting of the resistances of the resistor, the phosphor temperatures $T_0$, $T_1$, and $T_2$ were assumed to be equal to an environmental temperature +25° C., and the resistor temperatures $T_0'$, $T_1'$, and $T_2'$ were assumed to be equal to the environmental temperature +15° C.

Processes are similar to those in the first example except for a process of producing the resistor on the rear plate, and thus a duplicated explanation thereof is omitted.

Forming Resistor

The resistor 22*a* and the resistor 22*b* were formed at the same time.

A WGeON film was formed by performing sputtering using W and Ge as targets in a nitrogen ambient including a small amount of oxygen. Thereafter, a sequence of photolithography processes and RIE (reactive ion etching) processes were performed to form a predetermined pattern of the WGeON film. Then a resist was removed. As a result, the resistors 22*a* and 22*b* were obtained. The activation energy of the WGeON film was 0.3 eV, and the volume resistivity at 300 K was 75 Ωm. In the production of the resistor 22*a*, the thickness of the WGeON film was set to 50 nm, and the shape thereof was set to be equal to that in the first example. The resistance of the resultant resistor 22*a* was $1.5\times10^4$ Ω at the resistor temperature $T_1'$=315 K. On the other hand, as for the resistor 22*b*, the thickness of the WGeON film was set to 50 nm, and the area for the connection with the extension wiring 27 was set to be 6 times greater than that of the resistor 22*a*. The resistance of the resultant resistor 22*b* was $2.5\times10^3$ Ω at the resistor temperature $T_1'$=315K.

Next, the resistor 22*c* was formed in a similar manner to the resistors 22*a* and 22*b* except that the thickness of the WGeON film was set to 500 nm. The resistance of the resultant resistor 22*c* was $2.5\times10^2$ Ω at the resistor temperature $T_1'$=315K, Evaluation An image display apparatus was produced in a similar manner to the first example. Using a driving apparatus, −17.5 V was applied to the scanning signal wiring 23 connected to the respective sub-pixels in one pixel, and +10 V was applied to an information signal wiring 24 connected to the sub-pixel having the resistor 22*a*. At the same time, +8.5 V was applied to an information signal wiring 24 connected to the sub-pixel having the resistor 22*b*, and +8.5 V was also applied to an information signal wiring 24 connected to the sub-pixel having the resistor 22*c*. As a result, a device current of 100 μA was observed for all sub-pixels. In this situation, the environmental temperature was 300 K, the temperature of the face plate having the phosphors 14 was 325 K, and the temperature of the rear plate 12 having the resistors 22 was 315 K.

In response to the application of the voltages described above, all sub-pixels emit light simultaneously. The color observed as a whole of light emitted from the sub-pixels of one pixel was white, which was very similar to that in the first example. Color temperature was measured using a luminance colorimeter (BM-7 (available from Topcon techno house corporation). The measured color temperature was about 12000 K. Under the driving conditions described above, a change in color temperature was measured in an environmental test room over a range of environmental temperature from 280 K (7° C.) to 320 K (47° C.). A measurement result is shown in FIG. 13. A change in color temperature in a range of 12000 to 13000 K was observed when the environmental temperature was changed over a range from 280 to 320 K.

COMPARATIVE EXAMPLE

As for a comparative example, the first example described above was modified such that in the process of forming the resistors on the rear plate, the AuSiON film same as that used to form the resistor 22*c* in the first example was used for all resistors of each sub-pixel. The contact area between the resistor 22 and the extension wiring 27 was set to be 1.5 times greater than that in the first example. The activation energy of the AuSiON film was 0.05 eV, and the volume resistivity at a resistor temperature $T_1'$=315 K was 75 Ωm. When the film thickness was set to 50 nm, the resistance at the resistor temperature $T_1'$=315 K was $1\times10^4$ Ω. The process of producing the image display panel was similar to that in the first example except for the step of forming the resistor.

Figure 16:
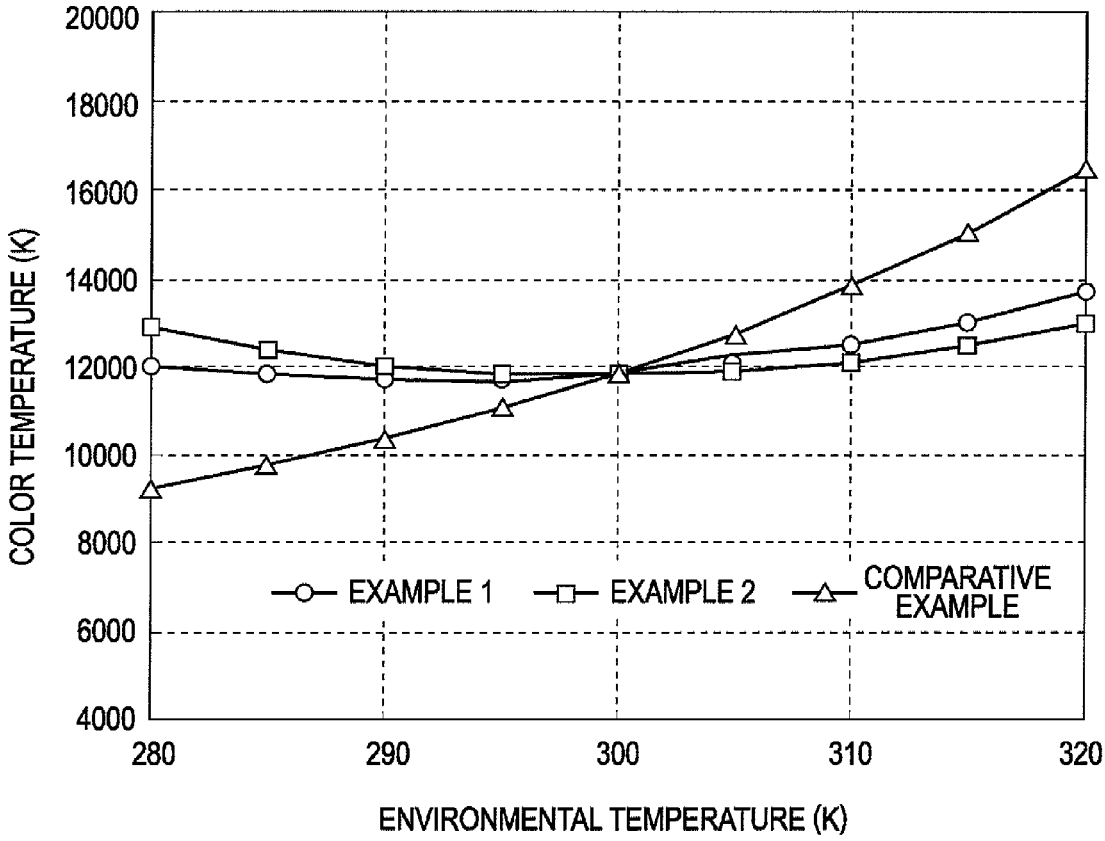
FIG. 16 is a graph showing characteristics evaluated for embodiments of the present invention and a comparative example.

A known driving apparatus serving as the driving unit 5 was connected to the produced image display panel to obtain an image display apparatus. Using the driving apparatus, −16 V was applied to the scanning signal wiring 23 connected to the respective sub-pixels in one pixel, and +17 V was applied to the information signal wirings 24 at the same time thereby simultaneously driving the respective sub-pixels in the one pixel such that the same emission current was obtained for all sub-pixels. A high voltage of +10 kV was applied to the back metal film 15 of the face plate 11 via a high voltage terminal. As a result, a device current of 100 μA was observed for all sub-pixels. In this situation, the environmental temperature was 300 K, the temperature of the face plate 11 was 325 K, and the temperature of the rear plate 12 was 315 K. In response to the application of the voltages described above, all sub-pixels emit light simultaneously. The color observed as a whole of light emitted from the sub-pixels of one pixel was white as with the first and second examples. No unevenness of brightness across the display screen was observed. Under the driving conditions described above, color temperature was measured using a luminance colorimeter (BM-7 (available from Topcon techno house corporation). The measured color temperature was about 12000 K. In an environmental test room, a change in color temperature was measured over a range of environmental temperature from 280 K (7° C.) to 320 K (47° C.). A measurement result is shown in FIG. 16. A change in color temperature in a range of 9000 to 16000 K was observed when the environmental temperature was changed over a range from 280 to 320 K.

THIRD EXAMPLE

Next, a third example is described. In the third example, a surface-conduction multilayer-structure electron emission device was employed for each electron emission device 20 of the rear plate 12. Instead of the resistors 22*a*, 22*b*, and 22*c* used in the first and second examples, resistors 42*a*, 42*b*, and 42*c* were used. The face plate and the display panel were produced in a similar manner to the first and second examples, and thus duplicated description thereof is omitted. The rear plate was produced in a different manner as described below. Note that a typical process of producing the surface conduction type electron emission device usable in this example, and typical characteristics thereof are disclosed in Japanese Patent Laid-Open No. 2001-167693 and Japanese Patent Laid-Open No. 2001-229809.

Figure 13A:
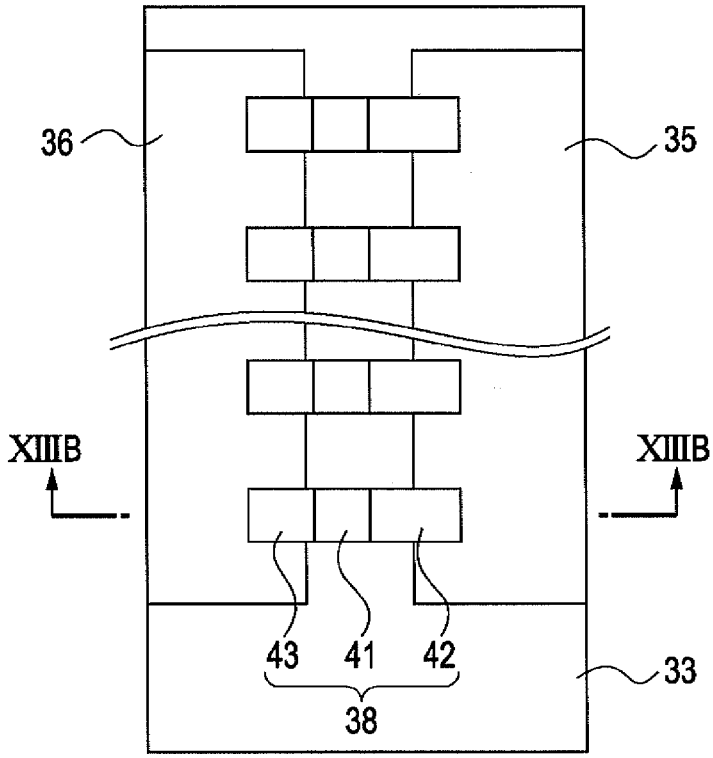
FIG. 13A is a plan view and FIG. 13B is a cross-sectional view thereof, illustrating a structure of electron emission devices of a surface conduction type and resistors according to an embodiment of the present invention.
Figure 13B:
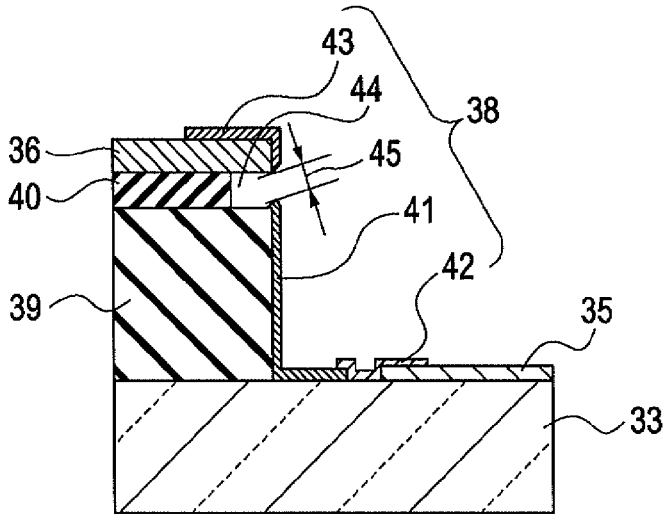

The electron emission device in the present example is illustrated in an enlarged manner in FIGS. 13A and 13B. FIG. 13A is a plan view seen from above, and FIG. 13B is a cross-sectional view taken along line XIIIB-XIIIB of FIG. 13A. In FIGS. 13A and 13B, reference numeral 41 denotes a strip-shaped cathode electrically connected to a cathode electrode 35 via the resistor 42. Note that the cathode 41 is partially located on a side wall of an insulating layer 39. Reference numeral 43 denotes a strip-shaped gate electrically connected to a gate electrode 36. Reference numeral 44 denotes a recess formed on a side wall of a step. This recess was formed by forming an insulating layer 40 such that a side wall of the insulating layer 40 was shifted inwardly from a side wall of the gate electrode 36 and a side wall of the insulating layer 39. Reference numeral 45 denotes a gap (shortest distance between the cathode 41 and the gate 43) in which to generate an electric field necessary for emitting electrons. Now, a process of producing the rear plate is described below.

Producing Rear Plate

Forming Scanning Signal Wiring and Cathode Electrode

Figure 14A:
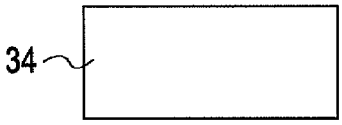
FIGS. 14A to 14E are diagrams illustrating a process of producing an electron emission device and wirings according to an embodiment of the present invention.
Figure 14B:
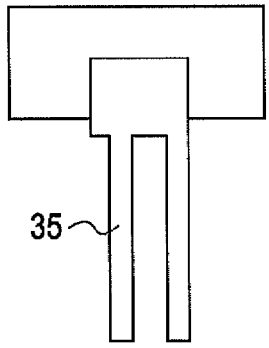
Figure 14C:
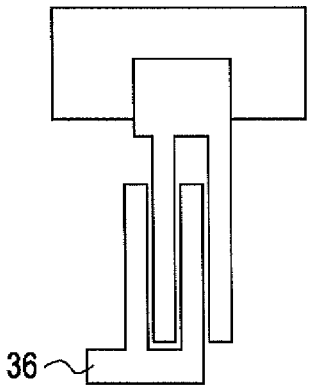

First, a Cu wiring was formed on a glass substrate 33 by using a photolithography technique thereby obtaining a scanning signal wiring 34 (FIG. 14A). A TaN film was then formed. The TaN film was patterned into a cathode electrode 35 (FIG. 14B).

Forming Gate Electrode and Recess

Figure 15A:
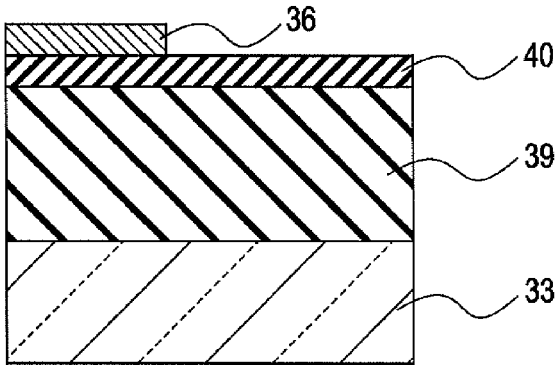
FIGS. 15A to 15E are diagrams illustrating a process of producing an electron emission device according to an embodiment of the present invention.
Figure 15B:
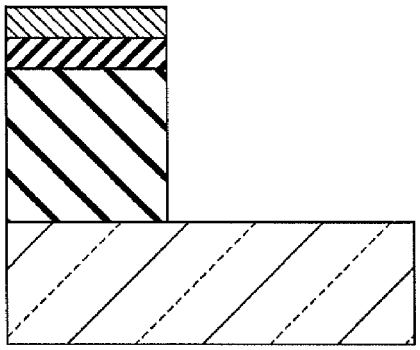
Figure 15D:
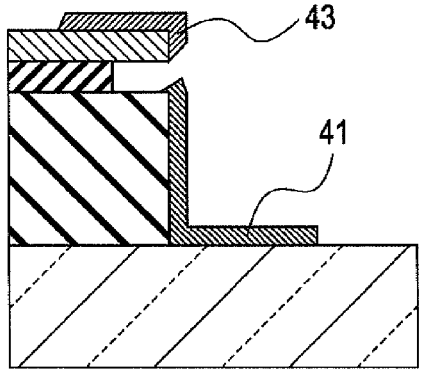
Figure 15C:
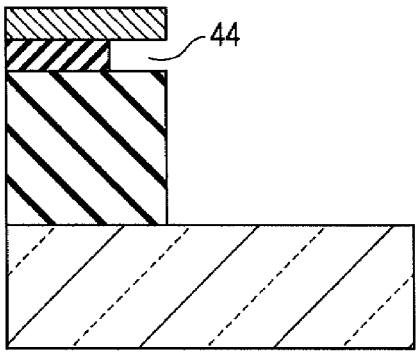

Next, a SiN film with a thickness of 500 nm serving as the insulating layer 39 was formed on the substrate 33. A $SiO_2$ film with a thickness of 30 nm serving as the insulating layer 40 was formed on the insulating layer 39. Furthermore, a TaN film with a thickness of 40 nm serving as the gate electrode 36 was formed on the insulating layer 40. Thereafter, the TaN film serving as the gate electrode 36 was patterned into a predetermined shape (FIG. 15A). Next, using a photolithography technique, the insulating layers 39 and 40 were patterned into a predetermined shape (FIG. 15B). Subsequently, the insulating layer 40 was etched so as to form the recess 44 (FIG. 15C).

Forming Information Signal Wiring

Figure 14D:
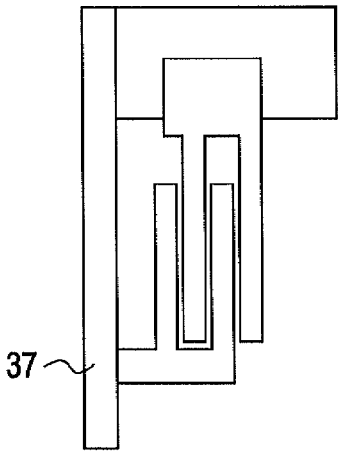
Figure 14E:
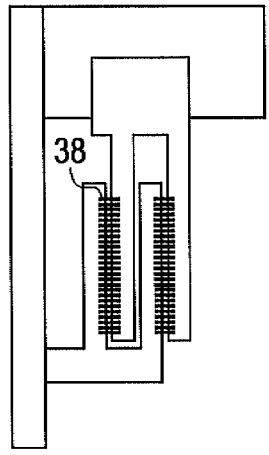

Next, a Cu film was formed, and was patterned into an information signal wiring 37 (FIG. 14D).

Forming Strip

Thereafter, using electron beam evaporation, a molybdenum (Mo) film was formed. A photoresist was then coated on the molybdenum film, and exposure and development was performed to pattern the molybdenum film into a predetermined shape thereby obtaining the cathode 41 and the gate 43 (FIG. 15D). The width of the cathode 41 and the gate 43 were set to 3 μm. As for the strips, 50×2 strips, i.e., a total of 100 strips were formed. The resultant structure was observed using cross-sectional transmission electron microscopy. The observation indicated that the size of the gap 45 was about 8 nm.

Forming Resistor

Figure 15E:
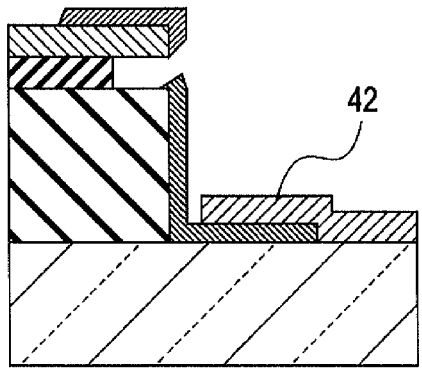

Finally, using a photolithography technique, a resistor 42 with a predetermined pattern was formed (FIG. 15E). The width of the resistor 42 was set to be equal to that of the cathode 41, i.e., 3 μm, and the thickness thereof was set to 200 nm. As for the number of resistors 42, 50×2 resistors, i.e., a total of 100 resistors were formed as with the strips.

In the process described above, the resistors 42*a*, 42*b*, and 42*c* were formed in this order. In FIG. 13 and FIG. 15, only one resistor 42 is shown. However, actually, there are three types of resistors 42*a*, 42*b*, and 42*c*. The resistor 42*a* was provided in a sub-pixel 6*a* having a phosphor 14*a* that emit red light. The resistor 42*b* was provided in a sub-pixel 6*b* having a phosphor 14*b* that emit green light. The resistor 42*c* was provided in a sub-pixel 6*c* having a phosphor 14*c* that emit blue light. The activation energy and the resistance of the resistors were set in a similar manner to the first example. In the first example described above, each sub-pixel includes one electron emission device. In contrast, in the present example, each sub-pixel includes a hundred electron emission devices, and thus the resistance of one resistor is 100 times greater than that in the first example. Note that as a whole of resistors 42 located in each sub-pixel, the resultant resistance of the resistors 42 located between the scanning signal wiring 34 and the information signal wiring 37 is equal to that in the first example.

More specifically, first, a WGeON film was formed by performing sputtering using W and Ge as targets in a nitrogen ambient including a small amount of oxygen. Thereafter, a sequence of photolithography processes and RIE (reactive ion etching) processes were performed to form a predetermined pattern of the WGeON film. Then a resist was removed. As a result, the resistor 42*a* was obtained. The activation energy of the WGeON film was 0.3 eV, and the volume resistivity at a resistor temperature $T_1'$=315 K was 0.15 Ωm. The composition of the WGeON film was set to be different from that in the first example. When the film thickness was set to 200 nm, the resistance of the resultant resistor 22*a* was $1.5\times10^6$ Ω at the resistor temperature $T_1'$=315 K.

Next, a PtAlON film was formed by performing sputtering using Pt and Al as targets in a nitrogen ambient including a small amount of oxygen. Thereafter, a sequence of photolithography processes and RIE processes were performed to form a predetermined pattern of the PtAlON film. Then a resist was removed. As a result, the resistor 42*b* was obtained. The activation energy of the PtAlON film was 0.1 eV, and the volume resistivity at 315 K was 0.15 Ωm. The composition ratio of the PtAlON film was set to be different from that in the first example. When the film thickness was set to 200 nm, the resistance of the resultant resistor 22*a* was $1.5\times10^6$ Ω at the resistor temperature $T_1'$=315 K.

Finally, an AuSiON film was formed by performing sputtering using Au and Si as targets in a nitrogen ambient including a small amount of oxygen. Thereafter, a sequence of photolithography processes and RIE processes were performed to form a predetermined pattern of the AuSiON film. Then a resist was removed. As a result, the resistor 42*c* was obtained. The activation energy of the AuSiON film was 0.05 eV, and the volume resistivity at a resistor temperature $T_1'$=315 K was 0.15 Ωm. The composition of the AuSiON film was set to be different from that in the first example. When the film thickness was set to 200 nm, the resistance of the resultant resistor 22*a* was $1.5\times10^6$ Ω at the resistor temperature $T_1'$=315 K.

Evaluation

A known driving apparatus serving as the driving unit 5 was connected to the image display panel to obtain an image display apparatus. Using a driving apparatus, −17.5 V was applied to the scanning signal wiring 34 connected to the respective sub-pixels in one pixel, and +10 V was applied to the information signal wirings 37 at the same time thereby simultaneously driving the respective sub-pixels in the one pixel such that the same emission current was obtained for all sub-pixels. A high voltage of +10 kV was applied to the back metal film 15 of the face plate 11 via a high voltage terminal. In the present example, although each sub-pixel includes 100 resistors, the resultant total resistance of the resistors in one sub-pixel is equal to that of the first example, and thus driving conductions are substantially equal to those of the first example. In this situation, the environmental temperature was 300 K, the temperature of the face plate 11 was 325 K, and the temperature of the rear plate 12 was 315 K. In response to the application of the voltages described above, all sub-pixels emit light simultaneously. The color observed as a whole of light emitted from the sub-pixels of one pixel was white as with the first example. In an environmental test room, the color temperature of the pixel was measured at various environmental temperatures. As with the first example, only a small change in color temperature was observed with a change in the environmental temperature.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-294592, filed Nov. 18, 2008, which is hereby incorporated by reference herein in its entirety.

What is claimed is:

1. An image display apparatus comprising a plurality of pixels each including three or more sub-pixels having different luminescent colors, the pixels being configured such that:

each sub-pixel includes a phosphor configured to emit light of a predetermined color when the phosphor is irradiated with electrons, an electron emission device configured to irradiate the phosphor with the electrons, and a resistor connected in series to the electron emission device and having a negative temperature characteristic of resistance, the temperature dependency of luminescent brightness of the phosphor and the activation energy of the resistor are different among the three or more sub-pixels with different luminescent colors included in each pixel, and in the three or more sub-pixels with different luminescent colors included in each pixel, a sub-pixel having a phosphor with a smaller temperature dependency of luminescent brightness has a resistor with a greater activation energy.

2. The image display apparatus according to claim 1, wherein each of the pixels includes three sub-pixels having luminescent colors of red, green, and blue, respectively, and the temperature dependency of luminescent brightness of the phosphor that emits red light is smaller than the temperature dependency of luminescent brightness of the phosphor that emits green light, and the temperature dependency of luminescent brightness of the phosphor that emits green light is smaller than the temperature dependency of luminescent brightness of the phosphor that emits blue light.

3. The image display apparatus according to claim 1, wherein the resistor has a resistance in a range from 100 Ω to 10 GΩ at 300 K.

4. The image display apparatus according to claim 1, wherein the resistor has a volume resistivity equal to or greater than $10^{-3}$ Ωm at 300 K.

5. The image display apparatus according to claim 1, comprising a face plate having the phosphors included in the respective sub-pixels of each of the pixels, and a rear plate having the electron emission devices and the resistors included in the respective sub-pixels of each of the pixels, the face plate and the rear plate being disposed such that the phosphors and the electron emission devices face each other.

6. The image display apparatus according to claim 1, further comprising a constant voltage source configured to supply a voltage to the electron emission device and the resistor.

7. An image display apparatus comprising a plurality of pixels each including three or more sub-pixels having different luminescent colors, the pixels being configured such that:

each sub-pixel includes a phosphor configured to emit light of a predetermined color when the phosphor is irradiated with electrons, an electron emission device configured to irradiate the phosphor with the electrons, and a resistor connected in series to the electron emission device and having a negative temperature characteristic of resistance, the temperature dependency of luminescent brightness of the phosphor is different among the three or more sub-pixels with different luminescent colors included in each pixel, the resistors are made of the same material for the three or more sub-pixels included in each pixel and having different luminescent colors, and in the three or more sub-pixels with different luminescent colors included in each pixel, a sub-pixel having a phosphor with a smaller temperature dependency of luminescent brightness has a resistor with a greater resistance.

8. The image display apparatus according to claim 7, wherein each of the pixels includes three sub-pixels having luminescent colors of red, green, and blue, respectively, and the temperature dependency of luminescent brightness of the phosphor that emits red light is smaller than the temperature dependency of luminescent brightness of the phosphor that emits green light, and the temperature dependency of luminescent brightness of the phosphor that emits green light is smaller than the temperature dependency of luminescent brightness of the phosphor that emits blue light.

9. The image display apparatus according to claim 7, wherein the resistor has a resistance in a range from 100 Ω to 10 GΩ at 300 K.

10. The image display apparatus according to claim 7, wherein the resistor has a volume resistivity equal to or greater than $10^{-3}$ Ωm at 300 K.

11. The image display apparatus according to claim 7, comprising a face plate having the phosphors included in the respective sub-pixels of each of the pixels, and a rear plate having the electron emission devices and the resistors included in the respective sub-pixels of each of the pixels, the face plate and the rear plate being disposed such that the phosphors and the electron emission devices face each other.

12. The image display apparatus according to claim 7, further comprising a constant voltage source configured to supply a voltage to the electron emission device and the resistor.

* * * * *